US009540843B2

(12) United States Patent
Garrett

(10) Patent No.: US 9,540,843 B2
(45) Date of Patent: Jan. 10, 2017

(54) LOCK PIN AND BOLT CONSTRUCTION FOR SECURING DOORS AND OTHER CLOSURES

(71) Applicant: SHADE RIVER OUTFITTERS, INC., Melbourne, FL (US)

(72) Inventor: Nicholas John Garrett, Branford, FL (US)

(73) Assignee: SHADE RIVER OUTFITTERS, INC., Melbourne, FL (US)

( * ) Notice: Subject to any disclaimer, the term of this patent is extended or adjusted under 35 U.S.C. 154(b) by 0 days.

(21) Appl. No.: 14/833,471

(22) Filed: Aug. 24, 2015

(65) Prior Publication Data

US 2016/0060918 A1 Mar. 3, 2016

Related U.S. Application Data

(60) Provisional application No. 62/128,660, filed on Mar. 5, 2015, provisional application No. 62/042,449, filed on Aug. 27, 2014.

(51) Int. Cl.
*E05G 1/04* (2006.01)
*E05B 15/10* (2006.01)
(Continued)

(52) U.S. Cl.
CPC ..... *E05B 15/102* (2013.01); *E05B 63/125* (2013.01); *E05B 65/0075* (2013.01); *E05C 5/02* (2013.01);
(Continued)

(58) Field of Classification Search
CPC ..... E05G 1/00; E05G 1/026; E05G 1/04; E05B 15/10; E05B 15/102; E05B 15/1621; E05B 2015/107; E05B 63/12; E05B 63/123; E05B 63/125; E05B 63/127;E05B 65/0075; E05C 5/00; E05C 5/02; E05C 5/04
See application file for complete search history.

(56) References Cited

U.S. PATENT DOCUMENTS 1,138,218 A 5/1915 Horspool
1,907,625 A * 5/1933 Vogt ..... E05B 65/0864 292/140
(Continued)

FOREIGN PATENT DOCUMENTS

DE 8909329 9/1989
GB 814816 6/1959
(Continued)

OTHER PUBLICATIONS

Industrie.com—Locking Bolts product information, [online, webpage, retrieved May 4, 2014] from: http://www.usinenouvelle.com/industry/kipp-werk-8485/locking-bolts-p37527.html, pp. 1-2.

*Primary Examiner* — Christopher Boswell
(74) *Attorney, Agent, or Firm* — Saliwanchik, Lloyd & Eisenschenk

(57) ABSTRACT

A rotatable lock pin that inhibits forced entry into a container through a closure by securing the lock pin to the container. A lock pin has a pin cylinder with a curvature of rotation that engages with a rotation facilitator. The path of the curvature of rotation and the engagement of the rotation facilitator therewith causes the lock pin to rotate in a pre-determined fashion, so that structures on the lock pin can engage or attach to some part of the container to secure the position of the lock pin and hold the closure door in place. Lock pins of the subject invention utilized with safes can inhibit forced entry through the door by side punching or prying of the door.

20 Claims, 9 Drawing Sheets

(51) Int. Cl.

| | |
|---|---|
| ***E05C 5/04*** | (2006.01) |
| ***E05B 65/00*** | (2006.01) |
| ***E05B 63/12*** | (2006.01) |
| ***E05C 5/02*** | (2006.01) |

(52) U.S. Cl.
CPC . *E05C 5/04* (2013.01); *E05G 1/04* (2013.01); *E05B 2015/107* (2013.01)

(56) References Cited

U.S. PATENT DOCUMENTS 2,235,949 A * 3/1941 Shaw ..... E05F 11/00 24/590.1
2,877,637 A * 3/1959 Greenwald ..... E05C 5/02 109/47
3,104,538 A 9/1963 Roberts et al.
3,415,086 A * 12/1968 Trainor ..... E05B 83/24 70/161
3,418,951 A 12/1968 Belew
4,123,925 A 11/1978 Nemec, Jr.
4,432,573 A 2/1984 Goldman
4,446,798 A 5/1984 Withington
4,468,943 A 9/1984 Beattie et al.
4,638,650 A 1/1987 Hafele
4,754,715 A 7/1988 Squires
5,231,935 A 8/1993 Oder et al.
5,253,904 A * 10/1993 Ruby ..... E05B 65/0864 292/58
5,275,029 A * 1/1994 Myers ..... E05B 35/008 292/60
5,280,973 A * 1/1994 Culling ..... E05B 17/0025 292/342
5,738,389 A 4/1998 Marks
7,665,405 B2 * 2/2010 Evans ..... E05B 65/0075 109/59 R
8,186,727 B2 * 5/2012 Rishel ..... E05B 15/102 292/142
2007/0261615 A1 11/2007 Evans et al.
2011/0083591 A1 4/2011 Stepp
2011/0174025 A1 7/2011 Rasmussen et al.
2011/0174199 A1 7/2011 Pendleton et al.

FOREIGN PATENT DOCUMENTS

GB 2086974 5/1982
JP 2004-092283 3/2004

* cited by examiner

LOCK PIN AND BOLT CONSTRUCTION FOR SECURING DOORS AND OTHER CLOSURES

CROSS-REFERENCE TO A RELATED APPLICATION

This application claims the benefit of U.S. Provisional Application Ser. No. 62/128,660, filed Mar. 5, 2015, and U.S. Provisional Application Ser. No. 62/042,449, filed Aug. 27, 2014, the disclosures of which are hereby incorporated by reference in their entireties, including all figures, tables, and drawings.

BACKGROUND OF INVENTION

Residential security containers are increasingly popular in use, particularly the larger styles often referred to as "gun safes" or "home safes." One of the most common styles of home safe is an upright, rectangular, free-standing structure, with a front opening door. These home safes usually have a safe body with a door frame defining an opening that leads to an interior space and a door attached to the safe body by hinges that swings into the opening in the door frame.

Most types of safes, including commercial safes and larger home safes, have a hand wheel or lever on the exterior side of the door that is attached through an opening in the door to a locking system on the interior side of the door. The locking system is usually attached to and controls the movement of carriages, which have a series of cylindrical lock pins attached thereto, positioned along the interior sides and sometimes the top and bottom of the door. Larger or commercial grade safes may have heavier carriages, more lock pins, or both; but, the principle of operation is often the same. There is a multitude of locking systems utilized with safes that include and are operated with a hand wheel or lever to move the carriages and the lock pins attached thereto. They typically operate by a lever system controlled with the hand wheel that is turned in one direction to move the carriage towards the edge of the door so that the lock pins are extended through pin holes in sides of the door panel frame. Thus, they can abut or otherwise engage with the door frame in the safe body to lock the door in place. If the hand wheel is turned in the opposite direction, the carriage is moved away from the door panel frame, retracting the lock pins through the pin holes, so they cannot abut the door frame, allowing the door to be opened.

Home safes that utilize this system can provide sufficient security for most situations. But, it has been shown that persistent effort with simple tools can effectively bend the door, bolt carriage, and/or the locking bolts so they no longer abut or contact the door frame, allowing access to the safe interior. This is often referred to as a "pry attack." There have been numerous advances and changes to the locking mechanisms employed with these types of devices and to the configuration and position of the carriages and lock pins relative to the door frame. However, there have been no real changes or improvements to the actual lock pins or methods by which lock pins can engage with the door frame or safe body to secure the door to the housing.

BRIEF SUMMARY

Embodiments of the subject invention are directed towards methods and devices for preventing a door, such as the door of a safe, from being breached by forcibly disengaging one or more lock pins so that they no longer conjoin with the door frame, safe body, or other securing structure around the door. The embodiments of the subject invention successfully address the above described disadvantages associated with the previously known lock pins and provide certain attributes and advantages that have not been realized by other known lock pins utilized in personal, home or commercial safes. The lock pin embodiments disclosed herein provide a novel, inexpensive, and convenient solution for better securing all types of closures against forcible entry.

In accordance with embodiments of the subject invention, the ability to forcibly breach an opening or door is inhibited by the use of lock pins that can be rotated, so as to directly couple or conjoin to one or more components of the safe body. The rotatable lock pin embodiments described herein can be employed as abutments against the door frame or other components of a safe body to prevent or inhibit opening of the door. One lock pin embodiment of the subject invention can also be advantageously configured to couple or conjoin to the door frame or another component of the safe body in a fashion that inhibits the lock pins from being bent, turned, pushed, or otherwise moved out of place, preventing them from operating as an abutment against opening the door, hatch, lid, window, or other type of closure. Additional lock pin embodiments can be configured to inhibit their being forcibly reversibly rotated and can have features that engage with one or more components of the door frame or safe body, particularly during a forced entry.

A specific embodiment of a rotatable lock pin, according to the subject invention, can have a first end that is rotatably attached to a carriage or other moveable structure, such as usually found in a safe. Most home safes, for example, have a carriage that is operated by a lever system controlled by the locking mechanism of the safe. The second, opposite end of the lock pin can have a latch that can be conjoined with or abut against another structure in the safe. Alternatively, the latch can be shaped so as to pass through a specifically configured opening, or key hole, located in the safe body, such as, for example, in the door frame, a strike plate, or another component of the safe body, as will be disclosed. The lock pin can further have one or more curvatures of rotation that cause the lock pin to rotate around the longitudinal axis of the lock pin.

In one embodiment, the curvature of rotation is provided by one or more grooves or cam tracks that curve, bend, or turn along at least part of the length of the lock pin. The cam track can be further cooperatively engaged with one or more cam guides that cause the lock pin to turn as it travels along the length of the cam groove or cam track. A cam guide can be located within pin holes in the door panel frame through which the rotatable lock pins can traverse prior to conjoining with or abutting against some other structure on the safe body. In a particular embodiment, there is at least one key hole in the safe body specifically shaped so as to allow the latch on the lock pin to pass through when aligned with the opening in one direction and prevent it from passing through or being removed from the key hole when misaligned or in a different direction.

Alternatively, a cam guide can be placed in another location and/or on another structure in a safe. For example, a cam guide could be located on the door frame of the safe, such that the lock pin will engage the cam guide after it exits the pin hole. The cam track can be configured to allow the pin cylinder to pass through a key hole and/or the cam guide a sufficient distance before rotating or turning to engage with the safe body or other securing structure.

Another embodiment provide a curvature of rotation by employing a lock pin having a non-circular circumferential shape, where the lock pin is also twisted between the proximal end and distal ends. This provides a lock pin with a linear curvature between the two ends. When mated with a compatibly shaped key hole and/or pin hole, the lock pin can turn as it advances through a hole. This can cause the same effect as a cam guide and groove described above, where the distal end is turned or rotated from its original position, as the locking mechanism is operated and the lockpins are moved linearly.

Operation of the locking mechanism in a safe can provide the force necessary to drive a lock pin and create the linear motion necessary to advance the one or more rotatable lock pins, attached to a carriage, through the pin hole in the door panel frame. This, in turn, can allow a latch, which is an extension on the lock pin, to pass through a keyhole opening. By way of a non-limiting example, as the lock pin moves through the pin hole in the door panel frame, a cam track can engage with the cam guide in the pin hole. As mentioned above, a cam guide can be located elsewhere on the safe, such that it is not continuously engaged with the cam track. This would cause the cam track on a lock pin to engage with a cam guide after the lock pin passes through a pin hole in the door panel frame. In another non-limiting example, a twisted lock pin could also have a latch and as the twisted on the lock pin is advanced through the pin hole, it can turn or rotate, causing the latch to also turn or rotate. Either configuration causes the linear motion of the lock pin to be translated into rotational motion, such that the lock pin turns, altering the alignment of the latch to a different location, position, or direction, such that the latch is no longer aligned with the key hole and/or becomes engaged with some structure on the safe body. This can prevent the lock pin from being either forcibly removed from the key hole opening and/or displaced from abutment against a door edge or other safe structure to which the latch has been conjoined. To remove a lock pin from a key hole or to unconjoin or disengage a latch, the locking mechanism can be operated in reverse, which will pull the carriage away, to which the lock pin is attached, from the door panel frame and simultaneously cause an embodiment of a lock pin to rotate in reverse to that it is returned to the original position, and so that the latch can become disengaged with the safe body and, if necessary, pass back through the key hole.

Often, when a home safe is breached, it is because the door was bent or pried sufficiently out of alignment to disengage one or more lock pins from the door frame. An alternative breach strategy is to drill one or more holes into the side of a home safe in a location that allows access to at least one lock pin. Because, in a typical home safe, all of the lock pins on each side of a door are attached to carriages, forcibly pushing just one lock pin back away from the door frame can, with some safes, simultaneously move all of the lock pins on that carriage, thereby simultaneously disengaging all of them from the door frame. Once all of the lock pins on a carriage are pushed back, the door can be easily opened after the locking mechanism is defeated.

One advantage of the lock pin embodiments of the subject invention is their ability to inhibit disengagement from their abutment against or across the door frame on the safe body by bending the lock pins themselves or bending other components in the safe to which the lock pin is attached. Because they can be secured at both ends to other components of the safe, it is more difficult to move or pry them away from the safe body, door frame, or other structures in the safe. Thus, attempting to bend or move the lock pins of the subject invention away from the door frame can entail also bending other components of the safe as well, such as the door or the carriage.

Other embodiments of a lock pin can have one or more cross-cuts that engage with components of a safe body only when there is an attempt to pry open the safe door. The cross-cuts can be perpendicular, or approximately perpendicular, to the longitudinal axis of a lock pin. When a safe door is pried it forces the lock pins against the door frame in an attempt to bend them. A cross-cut can be configured to "catch" on the door frame, inhibiting the lock pin from sliding against the door frame and being further bent out of place.

The embodiments of the subject invention successfully address the above described disadvantages associated with the previously known lock pin, particularly lock pins in safes, by providing devices and methods with certain attributes and advantages that have not been previously realized with known lock pins. In particular, the subject invention provides novel, inexpensive, and highly effective devices and methods for conveniently and more effectively engaging lock pins with a safe body or other structure. The embodiments disclosed herein can be incorporated with existing devices or mechanism, such as those on a safe, without having to alter, adjust, or otherwise change the locking mechanism of the device or mechanism.

It should be noted that this Brief Summary is provided to generally introduce the reader to one or more select concepts described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIGS. 10A and 10B illustrate a lock pin with an oval circumference, where the twist extends along most of the length of the pin cylinder. FIG. 10C illustrates a lock pin having a triangular circumference.

FIGS. 11A-11C illustrate a lock pin with a square circumference, where a portion of the lock pin has a twist. FIG. 11D illustrates a lockpin with a square circumference, where a portion of the lock pin has twist with a different turn radius than shown in FIGS. 11A-11C.

FIG. 12C illustrates how the shouldered indent can engage with a safe body during a pry attack.

DETAILED DISCLOSURE

Figure 1:
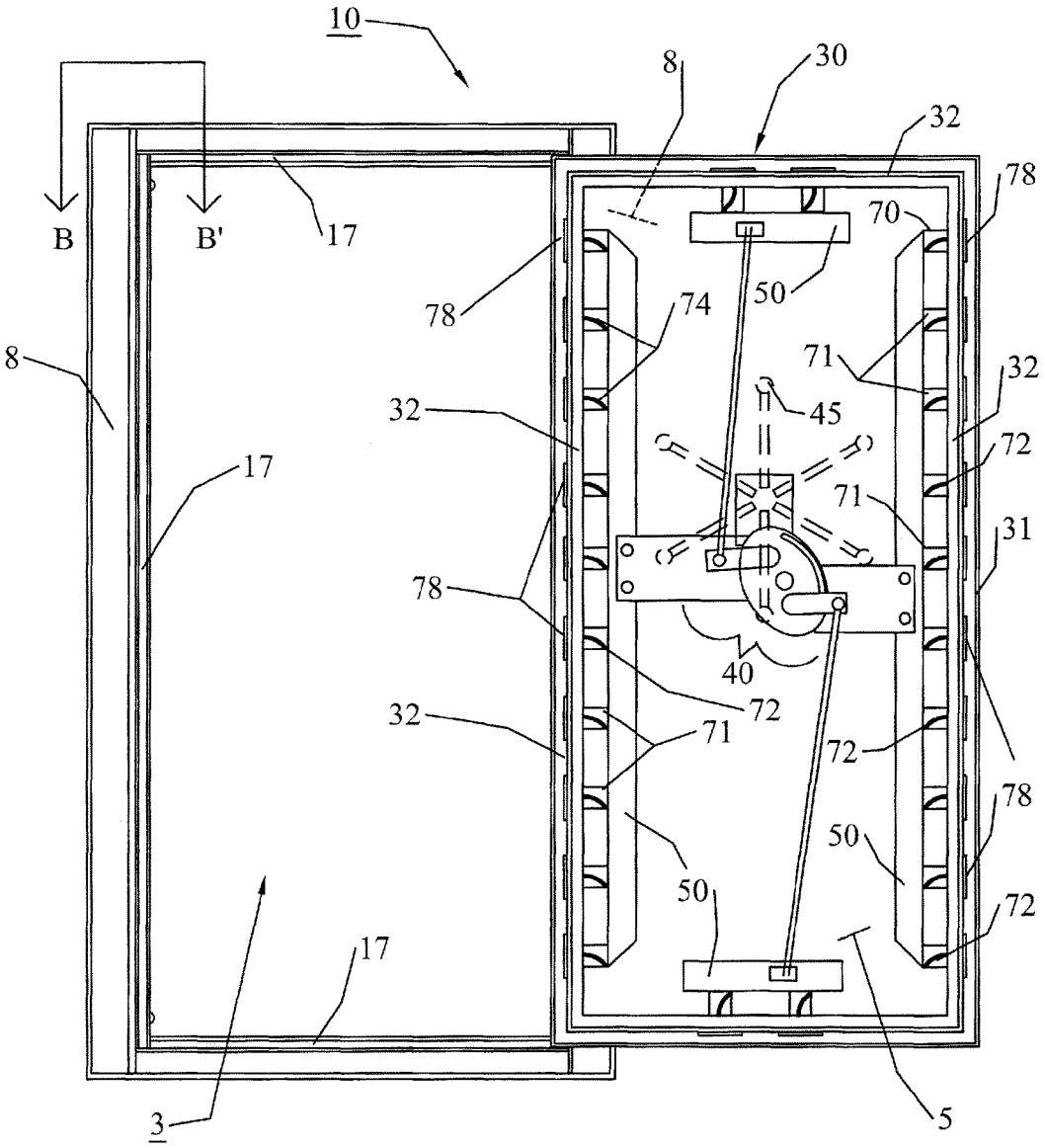
FIG. 1 shows a residential security container where the door has multiple lock bolts configured according to one embodiment of the subject invention. In this figure, the lock bolts are shown retracted away from the door edge to show the cam tracks.

The subject invention describes embodiments of a unique lock pin system that can be used with doors, lids, and other closures on rooms, containers, safes, or other devices or mechanisms that employ a lock pin or bolt to secure the position of a structure on the device or mechanism, such as, for example, the door on a safe. More specifically, the subject invention provides one or more embodiments of lock pins utilized with safes, such as residential security containers or larger commercial safes, or similar devices, where the lock pins are capable of being more securely attached to the safe body and are inhibited from being moved, damaged, or otherwise altered, so that they no longer operate to secure the door of a safe. More specifically, the embodiments of the subject invention allow at least two ends of a lock pin to be secured to inhibit bending of the lock pin or prying of the lock pin out of a position that allows it to secure the container.

The following description will disclose that the subject invention is particularly useful in the field of safes, e.g., residential security containers or gun safes. However, the embodiments herein are not limited to just use in safes. Any closure, such as a door, lid, hatch, window, and other opening can benefit from the device embodiments of the subject invention. Thus, while the subject application is written towards a use for residential security containers, a.k.a., safes, a person with skill in the art will be able to recognize numerous other uses to which the devices and methods of the subject invention would be applicable. Thus, while the subject application describes, and many of the terms herein relate to, modified lock pins for residential security containers, other uses and associated modifications, apparent to a person with skill in the art and having benefit of the subject disclosure, are contemplated to be within the scope of the present invention.

In the description that follows, a number of terms used related to safes are utilized. In order to provide a clear and consistent understanding of the specification and claims, including the scope to be given such terms, the following definitions are provided.

The terms "residential security container" and "safe" are interchangeable and used herein merely for literary convenience. These terms should not be construed as limiting in any way. The devices, apparatuses, methods, techniques, and/or procedures of the subject invention could be utilized with any type of container utilized for secure storage that can be locked and utilizes one or more lock pins or like components. This can include such containers as home safes, gun safes, wall safes, portable security safes, lock boxes, larger commercial safes, vaults, and other similar such devices. In addition, other locking mechanisms, such as deadbolts used to secure doors, hatches, windows, and the like, are also amenable for use with the embodiments of the subject invention.

Also, as used herein, and unless otherwise specifically stated, the terms "operable communication," "operable connection," "operably connected," "cooperatively engaged," and grammatical variations thereof mean that the particular elements are connected in such a way that they cooperate to achieve their intended function or functions. The "connection" or "engagement" may be direct or indirect, physical or remote.

Further, reference is made throughout the application to the "proximal end" and "distal end." As used herein, the proximal end is that end nearest to or having an operable connection to the locking mechanism of a residential security container. Conversely, the distal end of the device is that end furthest from the locking mechanism, or that end that can be secured to the safe body, according to the embodiments of the subject invention.

The present invention is more particularly described in the following examples that are intended to be illustrative only since numerous modifications and variations therein will be apparent to those skilled in the art. As used in the specification and in the claims, the singular for "a," "an," and "the" include plural referents unless the context clearly dictates otherwise.

Reference will be made to the attached figures on which the same reference numerals are used throughout to indicate the same or similar components. With reference to the attached figures, which show certain embodiments of the subject invention, it can be seen, for example, in FIGS. 1 and 2, that a safe 10 can, in general, include a safe body 15 with a hollow interior space 3 and a door 30, which each have interior surfaces 5 and exterior surfaces 8. There can further be a locking mechanism 40 on the interior of the safe and a locking mechanism control 45 on the exterior surface 5 of the door, as well as one or more carriages 50 arranged on the interior 8 of the door, where the carriages are movably controlled by operation of the locking mechanism.

Figure 2:
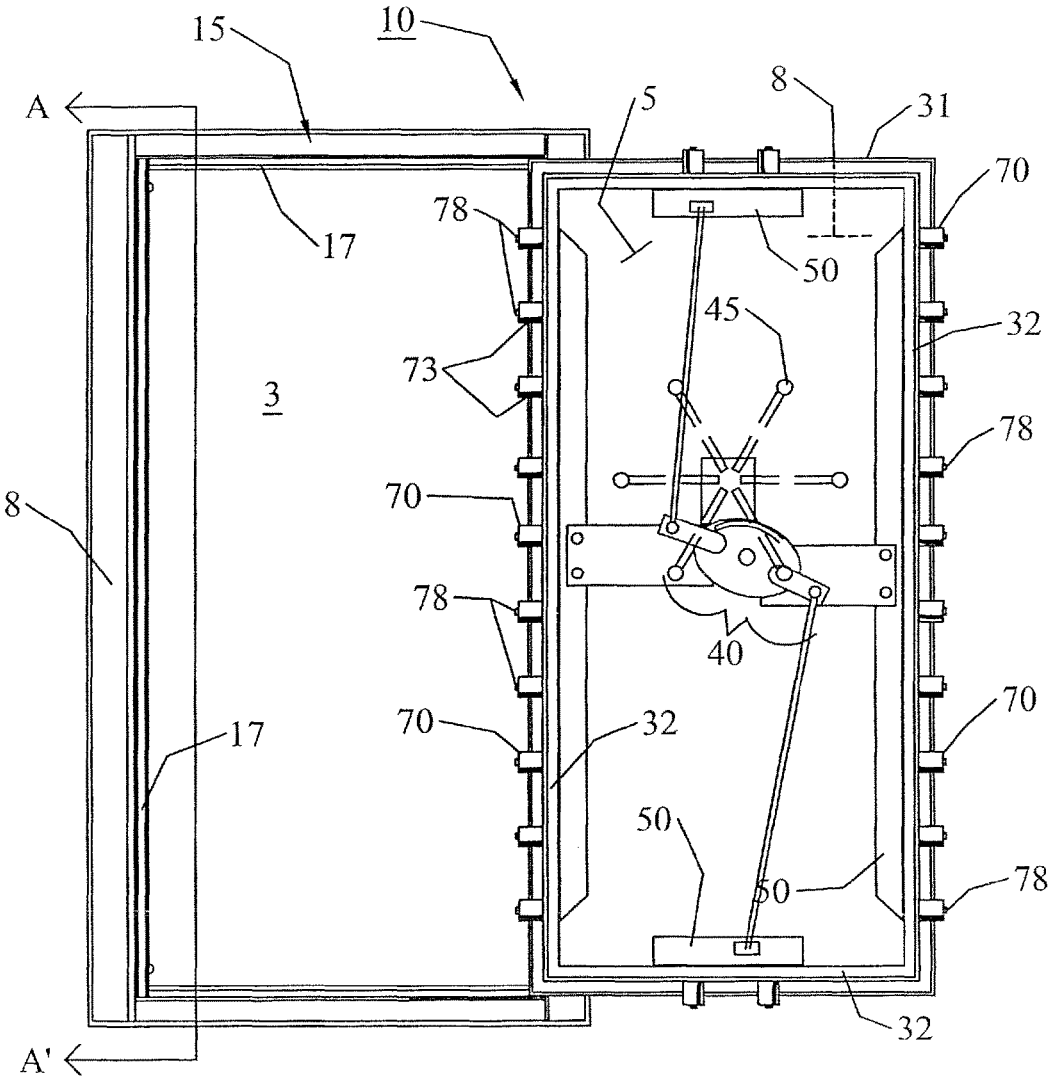
FIG. 2 shows a residential security container where the door has multiple lock bolts configured according to one embodiment of the subject invention. For the purposes of illustration, the door is shown opened, so the lock bolts can be seen extended past the door edge and the lock pins turned so that the latches are in a different alignment than shown in FIG. 1. Line A-A represents a cross-sectional view shown in FIG. 4A.

A typical safe requires that some type of combination, code, or other unique external input or command, or some combination thereof, be utilized to release the locking mechanism control 45, e.g., rotating handle or lever. The locking mechanism control can be operably connected to the interior locking mechanism, so that rotation of the handle causes the locking mechanism to move one or more carriages to or away from a door panel frame 32. A door panel frame in most safes is at least one panel of rigid material near the door periphery 31 that extends away from the interior surface 5. When the safe door is closed, the door panel frame extends into the hollow interior 3 of the safe. More typically, the door panel frame is a series of panels, which can be attached, of rigid material near the door periphery 31 that extend perpendicularly from the interior surface 5. When the door is closed in the door frame, the door panel frame 32 faces the hollow interior 3. An example of this is shown in FIGS. 1 and 2, which also show how turning of the locking mechanism control 45 to a different position moves the carriages 50 closer to the door panel frame and pushes the lock pins 70 through the pin holes 34 in the door panel frame. Thus, it is the operation of the locking mechanism on the carriages that provides the momentum or linear motion that moves the lock pins in one direction or another. This entire process can be done simultaneously by operating, e.g., turning, the locking mechanism control 45. This is the typical operation of most home or commercial safes. For the purposes of this description, the embodiments of the subject invention will be described in relation to their use with this type of safe, in particular a home safe or other type of residential security container. It will be understood by a person skilled in the art, having benefit of the subject disclosure, that the embodiments of the subject invention could be employed with other types of safe configurations or with any of a variety of products and devices, other than safes, that have similar operation and features. For example, the embodiments of the subject invention could be incorporated with deadbolts used on doors.

Figures 4A, 4B, 4C:
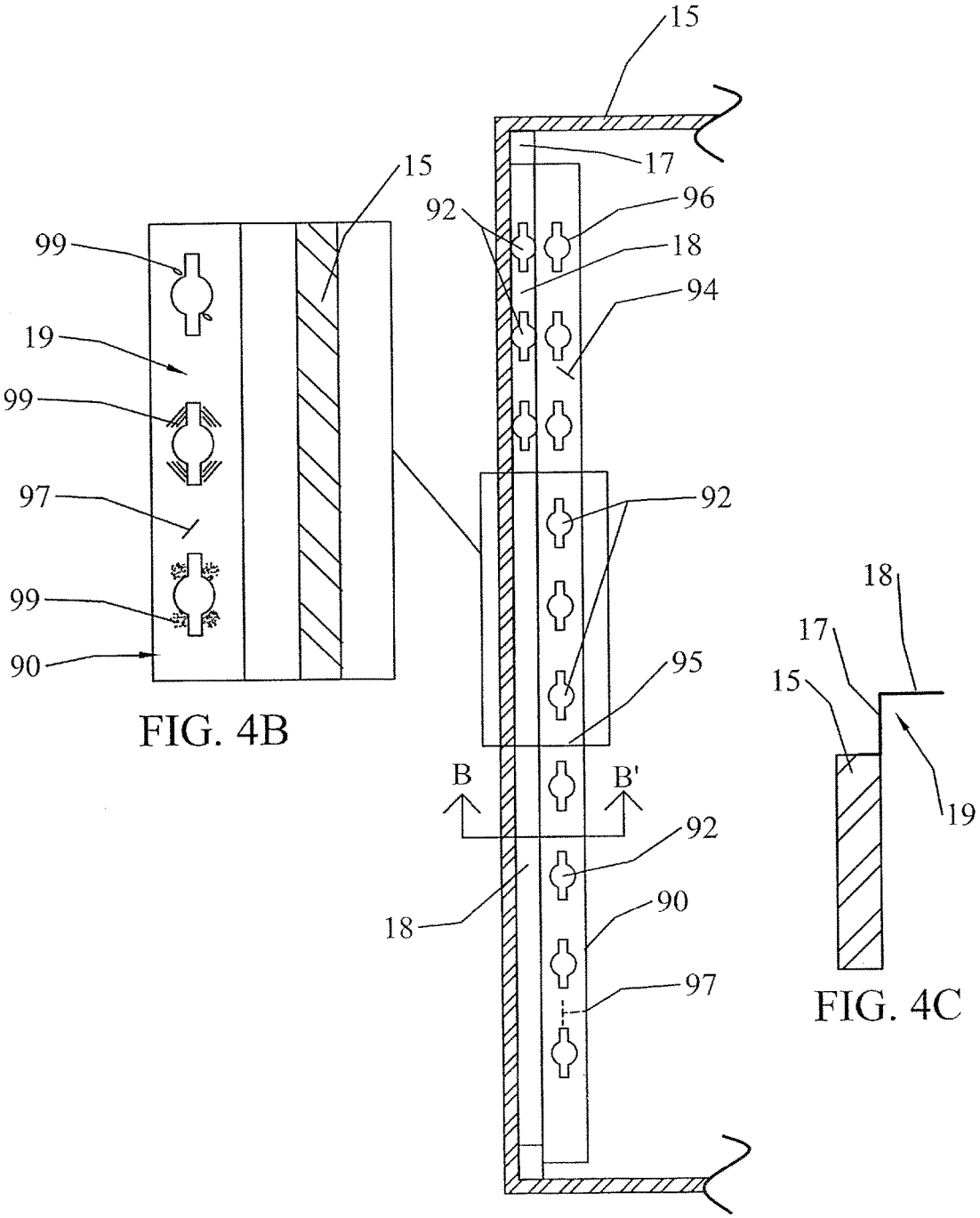
FIG. 4A is a cross-section taken along line A-A' in FIG. 2 to show one embodiment of a strike plate, according to the subject invention, affixed to the door frame.
FIG. 4B is an enlarged rear view of the backside surface of the strike plate in FIG. 4A, illustrating various, non-limiting, examples of abutment structures.
FIG. 4C is a cross-section taken along line B-B' in FIG. 4A to illustrate one possible configuration for a safe door frame and one possible attachment point for a strike plate.
Figure 5:
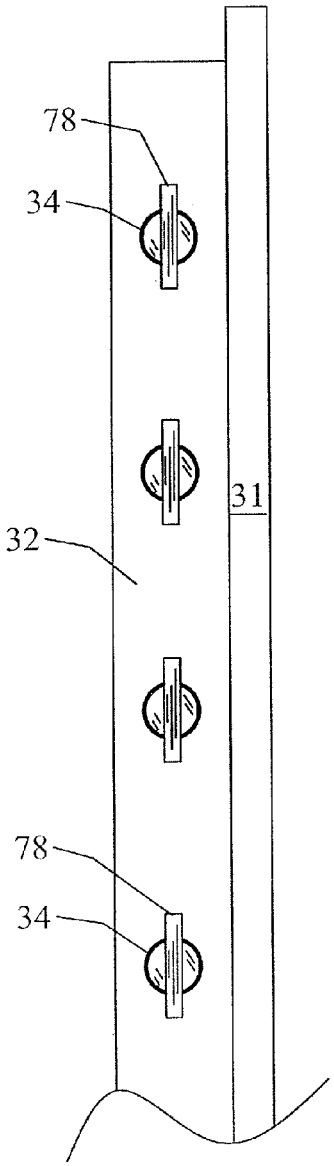
FIG. 5 illustrates a side view of a partial door panel frame with one embodiment of a lock pin according to the subject invention positioned within the pin holes in the door panel frame.

With regard to the above description, there can be attached to the carriages a plurality of lock pins 70, according to the subject invention, which can be moved towards and away from the door panel frame 32 by the movement of the carriages 50. As will be described below, a lock pin can be engaged with the safe body 15 or, in other embodiments, with a keyhole 92, so that the lock pin is inhibited or prevented from being forcibly retracted towards the door panel frame 32, or being pried or otherwise forced past the safe body, allowing the safe to open. In one embodiment, a lock pin can be secured to one or more structures already present on the interior of the safe body 15, such as, for example, around the door frame 17. Alternatively, a safe 10 can be modified to include one or more keyholes 92. In one specific embodiment, at least one strike plate 90 having one or more keyholes 92 can be incorporated into the interior of the safe body, an example of which is shown in FIG. 4A.

The embodiments of the subject invention pertain particularly to an improved lock pin 70 design that can be incorporated with the current designs for residential security containers. Advantageously, the lock pin embodiments of the subject invention can be operated in the same manner and with the same mechanisms currently used to control and move lock pins in residential security containers. Thus, current residential security container designs can incorporate one or more lock pins, according to the subject invention, without necessarily having to make any or significant changes to the other components of the security container. This can also permit residential security containers already in use to be retro-fitted to operate with one or more lock pins of the subject invention. The operation and mechanisms of residential security containers are well-known to those with skill in the art. Therefore, they will not be discussed herein, except as they relate to the lock pin embodiments of the subject invention and their operation.

The lock pin 70 embodiments of the subject invention, in general, have a curvature of rotation 300 between the proximal end 80 and the distal end 86 that, when engaged or activated, causes the lock pin to rotate or turn around the longitudinal axis 87 of the lock pin. The curvature of rotation is activated or engaged with a rotation facilitator 325 that operates with the curvature of rotation to rotate or turn the lock pin. Rotation of the lock pin can further cause the distal end of the lock pin or a component thereon, such as, for example, a latch to engage with another component to secure the position of the lock pin. This in turn, can secure a door, lid, window, hatch, or any other device to which the lock pin is operably connected.

Figure 3A:
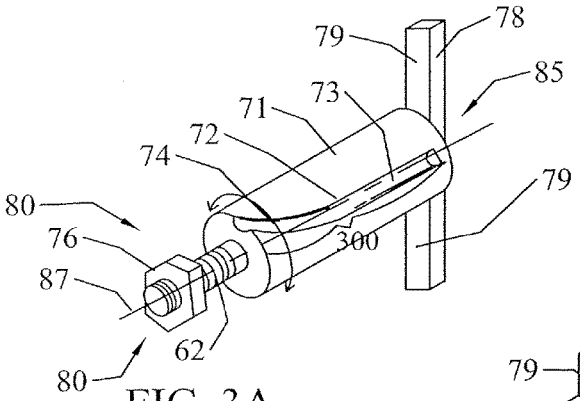
FIG. 3A shows a perspective view from the proximal end of one embodiment of a lock pin according to the subject invention.
Figure 6:
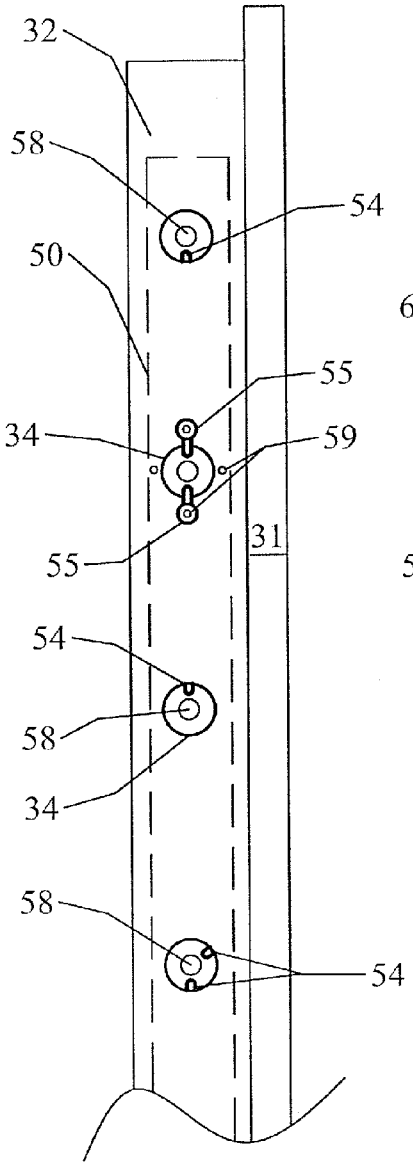
FIG. 6 illustrates a side view of a partial door panel frame showing the pin hole openings without lock pins emplaced therein. This figure shows some non-limiting examples of cam guides arrangements within the pin holes. Also shown in this figure is the location of a carriage (dashed lines) behind the door panel frame and the holes in the carriage for receiving a rotating connector apparatus.
Figure 7:
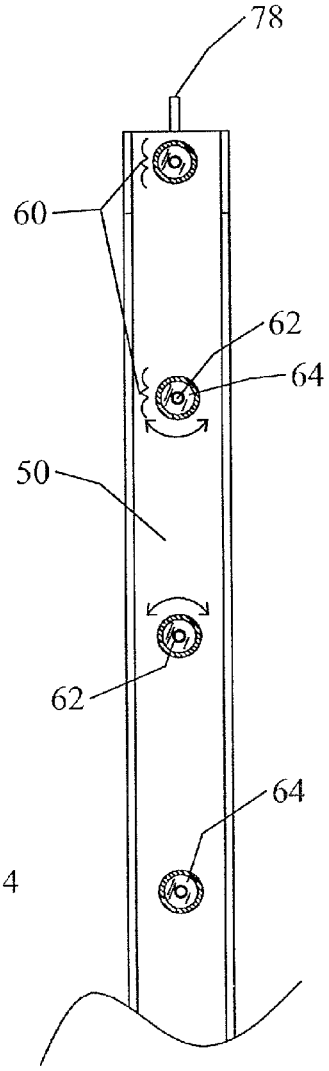
FIG. 7 illustrates a back side view of a partial carriage with lock pins rotatably attached.

One embodiment of a lock pin operates similarly to the principles of barrel cam and follower pin systems. However, the lock pin embodiments of the subject invention are novel in that the following pin, or rotation facilitator, is a fixed cam guide 54 and the barrel cam, having the curvature of rotation, is a linearly actuated pin cylinder 71. FIG. 3A illustrates one embodiment of a lock pin according to the subject invention. This embodiment utilizes a pin cylinder 71 as the mechanism for moving and rotating a latch 78. The proximal end 80 of the lock pin can be attached by a rotatable connector apparatus 60 to a carriage 50, as shown in FIG. 7, which is positioned on the interior surface 5 of the safe body 15, as shown, for example, in FIGS. 1 and 2. In one embodiment, the rotatable connector apparatus has a portion that extends through a hole 58 in the carriage, which is illustrated for example in FIGS. 6 and 7.

In one embodiment, the rotatable connector apparatus 60 allows the lock pin to rotate around the longitudinal axis 87 of the lock pin, as illustrated in FIG. 3A. This can allow a latch, fixedly attached to a distal end 85 of the lock pin, to turn simultaneously, which, as will be explained in further detail below, can secure the lock pin in a key hole 92.

The pin cylinder of a lock pin can provide the mechanism by which a latch is moved in and out of a key hole 92. In one embodiment, the pin cylinder 71 is an elongate, columnar shaped component, not unlike lock pins currently used in many safes. In a further embodiment, the lock pin is made of a rigid material that resists bending. Typical lock pins used in safes are made of steel, iron, or other high-tensile metals. However, alternative materials, such as, for example, carbon fibers, ceramics, plastics, or combinations thereof, can be utilized instead of or in addition to one or more metals. It is within the skill of a person trained in the art to determine an appropriate material for use as a pin cylinder. Such variations, which provide the same function, in substantially the same way, with substantially the same result, are within the scope of this invention.

Figure 9A:
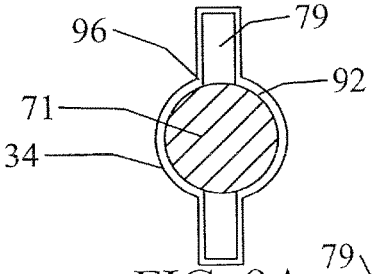
FIGS. 9A-9E show alternative embodiments of key holes.
Figure 9B:
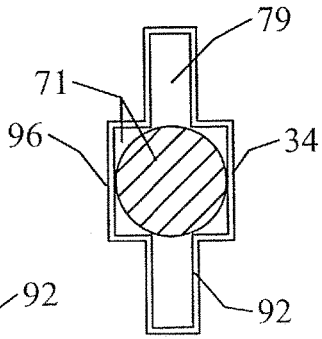
Figure 9D:
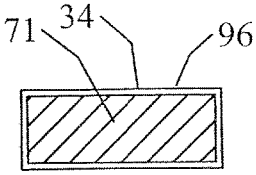

The lock pins used in most residential security containers, and other types of safes, have a circular circumferential shape, as shown in the example in FIG. 3A. The embodiments of the subject invention can be incorporated with these types of lock pins. In an alternative embodiment, the pin cylinder of a lock pin is non-circular. For example, a lock pin 70 can have a circumferential shape that is oval, square, triangular, rectangular, or another polygonal shape, examples of which are shown in FIGS. 9A-9E. In another alternative embodiment, only a partial length of the pin cylinder has one circumferential shape and the remaining length can have a different circumferential shape. By way of non-limiting example, some portion of a pin cylinder from the distal end 85 could be square in shape and another portion of the pin cylinder from the proximal end 80 could be circular in shape. FIG. 3C illustrates one possible example of this embodiment, where a distal end 85 portion of the pin cylinder is square and is attached or converts to a proximal end 80 portion with a circular circumferential shape, at which point the cam track can also begin to curve. This embodiment permits the pin hole 34 in a door panel frame to be a non-circular shape, although a circular shaped pin hole with appropriate dimensions could also be utilized with such an embodiment. FIG. 9B illustrates a specific, non-limiting example of a pin cylinder having a squared distal end and a circular proximal end operated through a part of a pin hole that is square. In yet another embodiment, a pin cylinder 71 can have a non-circular circumferential shape and can further be twisted along the length of the pin cylinder, to provide a curvature or rotation, such that the proximal end rotates similarly to a pin cylinder with a cam track. This embodiment allows the lock pin to be turned as it passes through a compatibly shaped keyhole, the rotation facilitator, and can eliminate the need for a cam guide. It is within the skill of a person trained in the art to determine any of a variety of circumferential shape configurations for a pin cylinder. Such variations are within the scope of this invention.

In addition, the diameter(s) of a pin cylinder can vary. It can be preferable for a pin cylinder to have the same or similar dimensions (diameter, length, etc.) as a lock pin used in a specific type or brand of safe. Thus, if an existing safe is to be retrofitted with the embodiments of the subject invention, minimal or no modifications to the other safe components are necessary. In one embodiment, the diameter of a pin cylinder is at least 0.5", 1", 1.5", 2", 2.5", 3", 3.5", 4", 4.5", 5", 5.5", 6", 6.5", 7", 7.5", 8", 8.5", 9", 9.5", 10", 10.5", 11", 11.5", or 12" or a size in a range between any two of the listed values. Typical residential security containers can have a pin cylinder diameter of at least 0.5", 1", 1.5", 2", 2.5", 3", 3.5", 4", 4.5", 5", 5.5", 6", 6.5", 7", or 7.5". Utilizing embodiments of the subject invention, it will be understood by a skilled artisan that the diameter of a pin cylinder can vary depending upon a variety of factors, including, but not limited to, width of a door panel frame, the size of a key hole, the dimensions of a carriage, the material of the pin cylinder, the circumferential shape of the pin cylinder, the size or type of safe in which the pin cylinder is used, etc. Such variations which provide the same function, in substantially the same way, with substantially the same result are within the scope of this invention.

In one embodiment, a pin cylinder has one or more cam tracks 72 that extend from at or about the proximal end 80 of the pin cylinder to at or about the distal end 85 of the pin cylinder. In an alternative embodiment, a cam track 72 extends from at or about the proximal end 80 of the pin cylinder to at or about the location of the latch 78. The cam track can open onto the proximal end 80 and/or the distal end 85 of the pin cylinder, such that there is a cut-out or divot 76 on the proximal end 80 of the pin cylinder, which can be seen, for example, in FIGS. 3C and 3D. Alternatively, the cam track can be closed at either end, such that it does not open onto either end of the pin cylinder. With this embodiment, the cam guide will be moveably retained within the cam track. A cam track can be operably engaged with a cam guide, as discussed below. The engagement of the cam track with the cam guide can determine at least the direction of rotation, the radius of rotation, and the timing of the rotation of a pin cylinder. The rotation of the pin cylinder can, advantageously, dictate the position of a latch 78, fixedly attached on or about the distal end of the pin cylinder, when the pin cylinder is engaged to lock the door 30. In other words, the rotation of the pin cylinder can simultaneously rotate the latch to a position that causes it to engage with some component of the safe, such as, for example, a strike plate, key hole, the door panel frame 32, or some other component.

In one embodiment, a cam track 72 is a channel or groove cut into or otherwise formed on the outer surface 75 of the pin cylinder 71. A cam track can be a cut-out channel within the pin cylinder, such that the cam track is recessed within the pin cylinder, which is shown, for example, in FIGS. 3A and 3B. This can allow the diameter of the pin cylinder to be such that there is minimal tolerance between the pin cylinder and the pin hole and/or a key hole. Alternatively, a cam track can be formed in relief on the outer surface 75 of the pin cylinder, whereby the cam track is raised above the outer surface of the pin cylinder, which is shown by further example in FIG. 3C. In one embodiment, two or more parallel walls traverse a length of the pin cylinder and form a cam track on the outer surface of the pin cylinder. This can allow the pin cylinder diameter to be smaller than the diameter of a pin hole and/or a key hole. A cam track can also be a combination of recessed and raised portions, which could depend upon the circumferential shape(s) of the pin cylinder. A person with skill in the art, having benefit of the subject application, would be able to devise any of a number of different types of cam tracks for a pin cylinder. Such variations are within the scope of this invention.

Figure 3B:
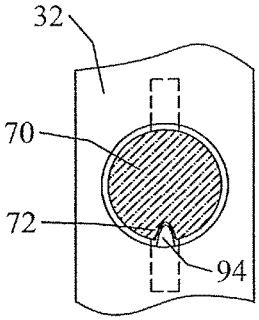
FIG. 3B shows a cross-sectional view of a lock pin within a pin hole in a portion of a carriage. This figure shows one example of a cam guide in the pin hole engaged with an embodiment of a cam track.

In a further embodiment, at least one cam guide 54 is disposed within a pin hole 34 and can extend into the cam track when the pin cylinder is positioned in the pin hole, such as shown, for example, in FIG. 3B. When a lock pin on a carriage is advanced toward the door panel frame 32, such that as the pin cylinder is pushed through the pin hole, the cam guide being disposed within the cam track causes the pin cylinder 71 to travel along a path and rotate as dictated by the cam track. The movement of the pin cylinder will be reversed when the carriages are retracted away from the door panel frame. Thus, the position or orientation of the latch 78 on the pin cylinder can be determined by the rotation of a pin cylinder. This operation is similar to the operation of a barrel cam and follower pin, mentioned above, where the follower pin moves in relation to the path of the track in a barrel cam as the barrel cam rotates. Embodiments of the subject invention employ a reversed configuration of this mechanism, whereby the cam guide, a.k.a., follower pin, is stationary and causes the lock pin, a.k.a., barrel cam, which moves linearly, to rotate according to the path of the cam track thereon. Thus, as the pin cylinder is moved through the pin hole, the cam guide forces the pin cylinder to rotate according to the path of the cam track along the length of the pin cylinder.

FIGS. 1, 2, and 3A illustrate one embodiment wherein the carriages 50 on a safe door 30 are retracted, so that the distal ends 85 of the lock pins thereon are within the pin holes in the door panel frame and the latches 78 are abutted against the outside of the door panel frame. A curved section of the cam track closer to the proximal end 85 of the lock pins can be seen along the sides of the pin cylinders and in FIG. 3. FIG. 2 illustrates that the lock pins will turn within the pin holes when the carriages are brought closer to the door panel frame. In FIG. 2 it can be seen that the orientation of the latches 78 changes. In this example, the latch changes from a vertical alignment to a horizontal alignment when the lock pins are pushed through the pin holes. Further, the distal end 85 of the lock pins can be seen showing a straight portion of the cam tracks. If the door of the safe is closed when the latches turn, they can engage with a key hole or other feature on the door frame, preventing the pin cylinder from being forcibly pushed out of the key hole or towards the door panel frame.

As mentioned above, there can be more than one cam track on a pin cylinder and more than one cam guide in a pin hole. Further, since a safe usually has more than one lock pin, each lock pin could have one or more cam tracks and pin holes in different locations. FIG. 6 illustrates some alternative embodiments for cam guides within a pin hole. It can be seen that a cam guide can be located anywhere around the circumference of a pin hole. There can also be more than one cam guide, such that each cam guide is operatively engaged with a cam track on a pin cylinder. The use of more than one cam track and cam guide is not required. But, it can add an additional level of security to the lock pins. It can also help ensure proper alignment of the pin cylinder and inhibit jamming of the lock pins.

As described above, a cam guide 54 can be used to engage with a cam track 72 so as to, essentially, force a pin cylinder to follow a pre-determined rotation. Thus, it can be advantageous for the cam guide to be sufficiently rigid to operate with the cam track. As will be described in detail below, a cam track can have any of a variety of configurations, including being cut into or raised above the outer surface of a pin cylinder. A cam track can also have a consistent or a variable depth along its length. Ideally, a cam guide extends into an opening through which a pin cylinder will pass, examples of which are shown in FIG. 6. However, a cam guide can also be attached to other structures with which a pin cylinder may only come into proximity with and not necessarily pass through. These other structures may be part of the door or they can be in other parts of the safe, whereby the pin cylinder could engage with the cam guide before or after it passes through the pin hole.

In one embodiment, a cam guide is fixedly and/or permanently attached to a structure, by any device or technique known in the art, so that at least a portion of the cam guide forms a sort of tooth, flange, or other projection that juts into or imposes into the space of the opening. In one embodiment, a cam guide is cut or formed within the pin holes 34, such that it is coplanar with the pin hole. In an alternative embodiment, a cam guide is positioned on either side of a pin hole, such that it is not coplanar with the pin hole, but still extends towards and intersects the pin hole, so that a pin cylinder and cam track operating within the pin hole can encounter and interact with the cam guide. With these embodiments, the cam guide is formed as part of the carriage, so that the shape, depth, and location of the cam guide can be fixed and immovable.

In an alternative embodiment, the cam guide is attached by using other devices or techniques, known in the art, that allow the cam guide to be moveable, interchangeable, and/or adjustable. With this embodiment, the cam guide depth, shape, and location can be altered as necessary to accommodate different cam track embodiments. In one embodiment, the structure to which a cam guide is attached includes one or a plurality of adjustment holes 59. In a further embodiment, a cam guide can have a tail piece 55 that can be used to attach the cam guide to any one or more of the adjustment holes. By way of non-limiting example, the tail piece 55 can be a flange attached to a cam guide that can be further attached by a screw or bolt through the adjustment hole to the structure. FIG. 6 illustrates an example of this embodiment, where the flanges 59 on two cam guides are adjustably attached to a structure, in this case to a carriage 50, using the adjustment holes 55, so that the cam guide portion extends into a pin hole 34. There are a myriad of devices and techniques known to those with skill in the art by which a cam guide can be fixedly or removably attached to a structure, so that it can operate with a cam track. Such variations which provide the same function, in substantially the same way, with substantially the same result are within the scope of this invention.

Figure 8A:
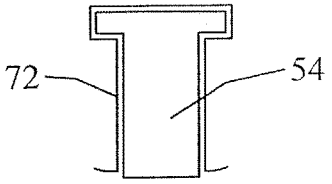
FIGS. 8A-8D show alternative embodiments of cam guides.
Figure 8B:
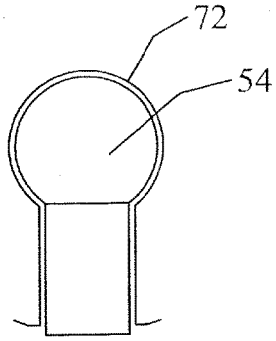
Figure 8D:
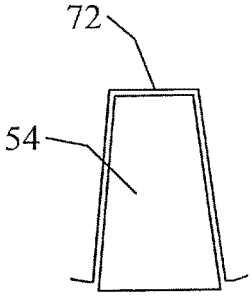
Figure 8C:
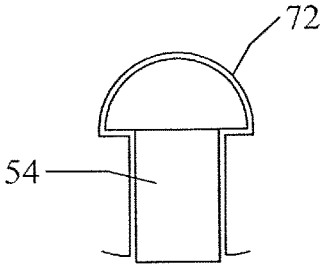

The depth of a cam track 72 can depend upon several factors, including, but not limited to, the length, shape, or number of cam guides; the diameter of the pin cylinder; the type of cam track utilized (recessed or relief); and other factors understood by those with skill in the art. A cam guide can have a consistent depth along its length. Alternatively, a cam track can a variable depth along its length, which could accommodate pin cylinders having different shapes along their length, such as shown, for example in FIG. 3A. FIGS. 3A and 3B illustrate one embodiment having a cam track that is essentially a U-shaped groove that can be interdigitated with a similarly U-shaped cam guide. However, other cam track and cam guide shapes can be utilized. For example, the width of a cam track can vary at different depths, such that a portion of the cam track can be wider at one depth than at another depth. FIGS. 8A-8D illustrate some examples of alternatively shaped cam guides 54 and cam tracks 72. It can be seen in FIGS. 8A-8C that certain embodiments of a cam guide can have an interdigitated shape that inhibits it from being removed from along the length of the cam track. FIG. 8D illustrates an example of a cam guide having a shape that can prevent or inhibit it from being removed at a point along the length of the cam track. Alternative configurations for cam tracks and cam guides can be determined by a skilled artisan. Such variations which provide the same function, in substantially the same way, with substantially the same result are within the scope of this invention.

Ideally, the length of a pin cylinder 71 and the path of a cam track 72 are designed so that when the pin cylinder 71 is fully extended through a key hole 92 and the latch 78 is turned, the safe door 30 is held firmly within the door frame 17 of the safe 10. This operation can be realized whether the cam guide is within a pin hole or located elsewhere in a safe. It can be preferable for a pin cylinder to have the same dimensions (diameter, length, etc.) as a standard lock pin used in a specific type or brand of safe. Thus, if an existing safe is to be retrofitted with the embodiments of the subject invention, minimal or no modifications to the other safe components would be necessary. In one embodiment, the length of a pin cylinder is at least 0.5", 1", 1.5", 2", 2.5", 3", 3.5", 4", 4.5", 5", 5.5", 6", 6.5", 7", 7.5", 8", 8.5", 9", 9.5", 10", 10.5", 11", 11.5", or 12", or a length in a range between any two of the listed values. It will be understood by a skilled artisan that the length of a pin cylinder can vary depending upon a variety of factors, including, but not limited to, the position of the carriages, the distance traveled by the carriages during operation of the locking mechanism 40, the location or configuration of the one or more key holes, and the configuration of the door frame 17.

The length, turning radius or "pitch," and linear path of a cam track can be important to the overall operation of a pin cylinder of the subject invention. These factors can also vary depending upon, for example, pin cylinder length, pin cylinder circumferential shape(s), location of the pin hole, the distance of a key hole from a pin hole, as well as other factors that would be understood by a person skilled in the art. The length and shape of the cam track can dictate the rotation and timing thereof a pin cylinder and when the latch 78 will engage with a key hole 92 or other structure on the safe. The cam track can also dictate how the pin cylinder is retracted and how close the distal end is pulled to the door panel frame to unlock the door.

Usually, though not mandatorily, the cam track 72 has a straight run 73 portion that maintains the pin cylinder 71 in one position so that the latch 78 is oriented to pass through a key hole or be properly emplaced relative to a structure on the door frame 17 or components thereof. Following the straight run 73, there can be a curved run 74 portion of the cam track that causes the pin cylinder to rotate, resulting in a reorientation position of the latch. It is important that the curved run 74 be configured to turn the pin cylinder only when a sufficient length thereof has been extended from the door frame so that the latch has been passed through the key hole or been otherwise properly oriented with the door frame. If the latch is turned prematurely, the door 30 of the safe might not close or lock properly.

Alternatively, the cam track 72 can be curved along the entire length of the pin cylinder. The key hole or other structure can be adjusted in size, shape, and/or orientation to accommodate the latch rotating as it approaches the key hole or other structure. Alternative cam track paths are also possible and can depend upon the configuration of the latch and/or key hole.

As detailed above, the operation of the lock pins is ultimately controlled by the operation of the locking mechanism control 45, e.g., handle, on the outside of the safe door 30. In one embodiment, the pitch of the curved run is such that there is a smooth, uninterrupted motion when the locking mechanism control advances the pin cylinder. In other words, the transition of the cam guide from a straight run 73 to a curved run 74 is minimally detectable when the locking mechanism control is utilized. In one embodiment, the curved run has a pitch that facilitates rotation of the latch as soon as possible after it is in the correct position in a key hole or with the door frame. This can ensure that there is minimal tolerance between the latch and the key hole or door frame structure and holding the door firmly in the door frame. Alternatively, the latch can turn at any time after it passes through the key hole or other structure and not have to engage with or even contact any part of the safe, key hole, etc.

In one embodiment, the curved run 74 of a cam track is located at approximately the distal ⅔ of the pin cylinder. In a more particular embodiment, the curved run of a cam track is located within approximately the distal ½ of a pin cylinder. In a specific embodiment, the curved run of a pin cylinder is located within approximately the distal ⅓ of the pin cylinder.

It can be preferable, though not required, for the cam track to provide a rotation to the pin cylinder that causes the latch to be oriented so that it is maximally mis-aligned with the keyhole. Alternatively, it can be preferable, though not required, that the orientation of the pin cylinder causes the latch to be maximally engaged with the door frame or some component thereof. This can ensure that the latch does not accidentally realign with the keyhole or that the latch cannot be easily realigned with the keyhole if access to safe interior or hollow area 3 is gained with one or more drilled holes, as described above. However, in some situations, it may be possible or preferred for the latch to be turned only as far as necessary to ensure that it is properly engaged. Any amount of rotation that causes a latch to be sufficiently misaligned with a keyhole so as to prevent the pin cylinder from reversing direction in the key hole is within the scope of this invention.

Another embodiment employs a non-circular pin cylinder, mentioned above, that further has one or more twists or rotations at some point or along the entire length of longitudinal axis 87 between the proximal end 80 and the distal end 85, such that the distal end and the proximal end can be misaligned, when viewed from one of the ends or along the longitudinal axis of the pin cylinder. The turn radius of each one or more twist can vary and will dictate how much or whether the proximal end and distal end are misaligned, which is shown, for example, in FIGS. 10A-11D.

In a further embodiment, a pin hole 34 has a shape that engages with one or more sides and/or edges of the one or more twists 100 in a pin cylinder 71, causing it to rotate as it passes therethrough. FIGS. 9A-9E illustrate non-limiting examples of pin hole shapes that can be employed with embodiments of the subject invention. A twisted pin cylinder embodiment can operate similar to a screw being turned in a hole. If a latch is affixed to the distal end 85, the rotation of a pin cylinder having one or more twists 100 will cause the latch to rotate similarly or identically as described above for the embodiments using a cam guide and cam track to rotate the pin cylinder. The shape of a pin hole 34 can be such that there is minimal friction or "stiction" between the pin cylinder twist 100 and the pin hole edges 35. It is not uncommon for corner areas to have an affinity for stiction interference. In one embodiment, the corners of a pin hole are slightly rounded. In another embodiment, the corner areas can have a clearance cut 36, so that the corners are rounded and extend past the edges 35 of the pin hole, such as shown for example in FIG. 9E.

FIGS. 10A, 10B, and 10C and FIGS. 11A, 11B, 11C, and 11D illustrate non-limiting embodiments of pin cylinders 71 having non-circular circumferential shapes, i.e., oval and quadrilateral, respectively, that have one twist between the proximal end 80 and the distal end 85. The embodiments of the subject invention are not limited to the circumferential shapes shown in these figures. Thus, a pin cylinder can have any of numerous non-circular circumferential shapes, and, when engaged with an appropriately shaped keyhole 92 or pin hole 34 could have more than one circumferential shape. In fact, a key hole and/or a pin hole with which the twisted pin cylinder engages can have a shape that may not be similar to the circumferential shape of the pin cylinder, but may still have one or more edges that engage with one or more sides or edges of a twisted portion of a pin cylinder causing it to rotate. A twisted pin cylinder could also have a portion that is cylindrical or that is non-cylindrical and not twisted and one or more other portions that are non-cylindrical and twisted such that a pin cylinder could travel some distance through a pin hole along the untwisted portion without being turned. When the twisted or rotated portion encounters the pin hole, the twisted pin cylinder can turn or rotate appropriately. FIGS. 10A-11D illustrate this embodiment. A person with skill in the art will understand that there can be numerous combinations of twisted, untwisted, and various degrees of twist applied to a pin cylinder. Any such variations, which provide the same function, in substantially the same way, with substantially the same result, are within the scope of this invention.

Figure 10A:
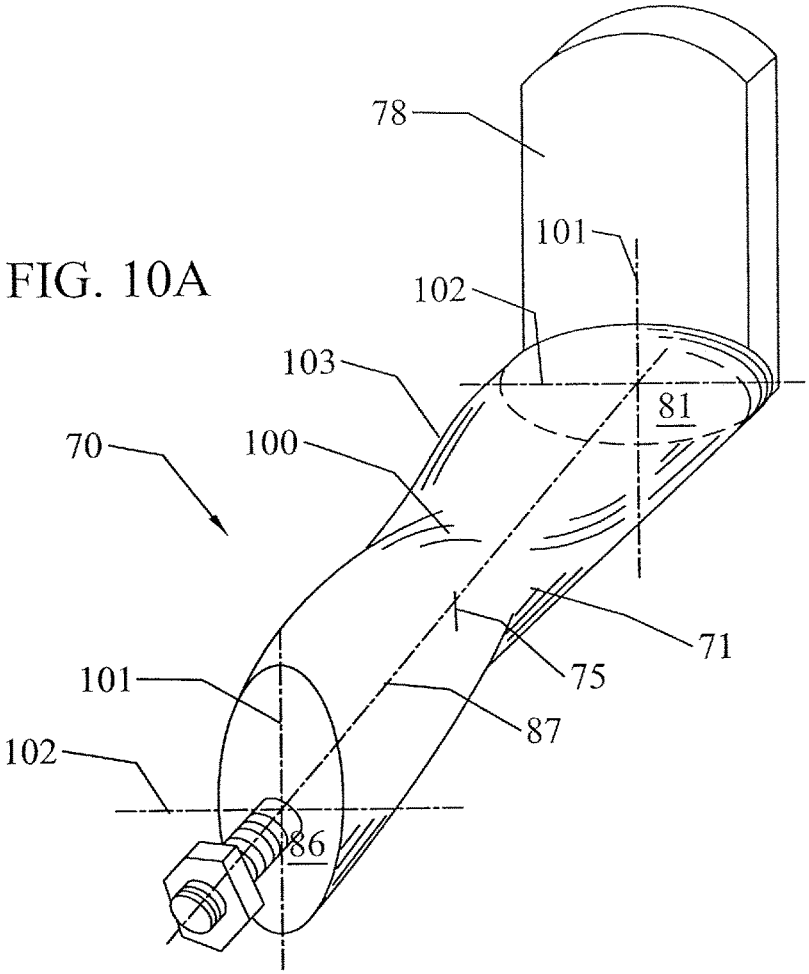
FIGS. 10A, 10B, and 10C show embodiments of a lock pin with a twist, according to the subject invention.
Figure 10B:
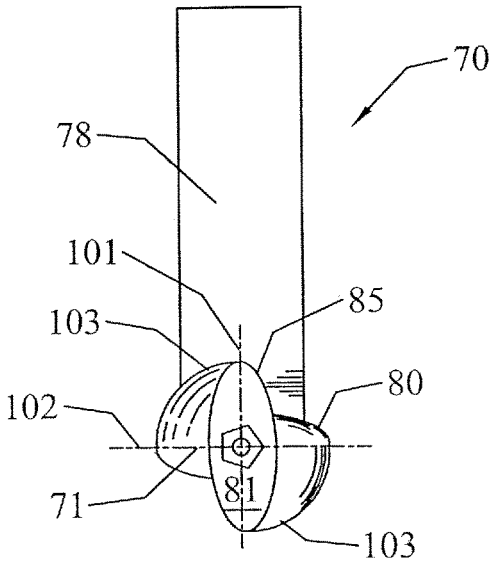
Figure 10C:
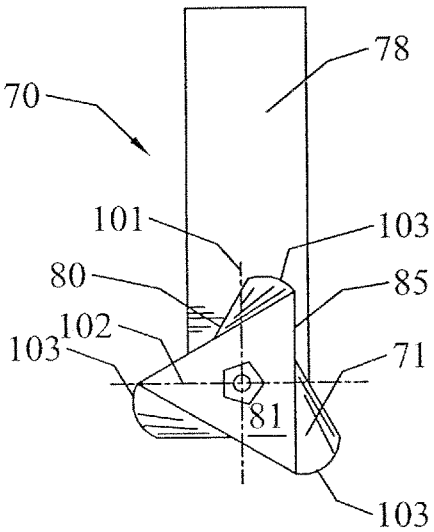
Figure 11A:
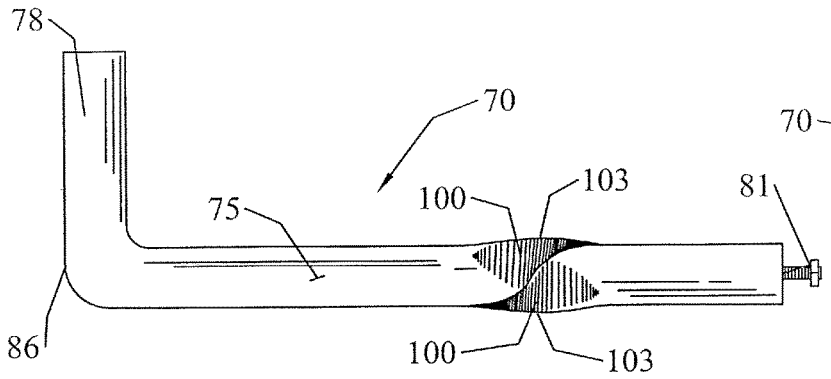
FIGS. 11A, 11B, 11C, and 11D show alternative embodiments of a lock pin with a twist, according to the subject invention.
Figure 11C:
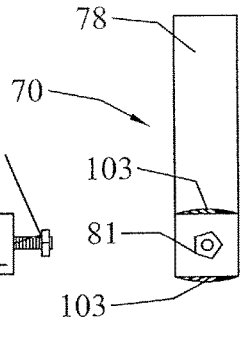
Figure 11B:
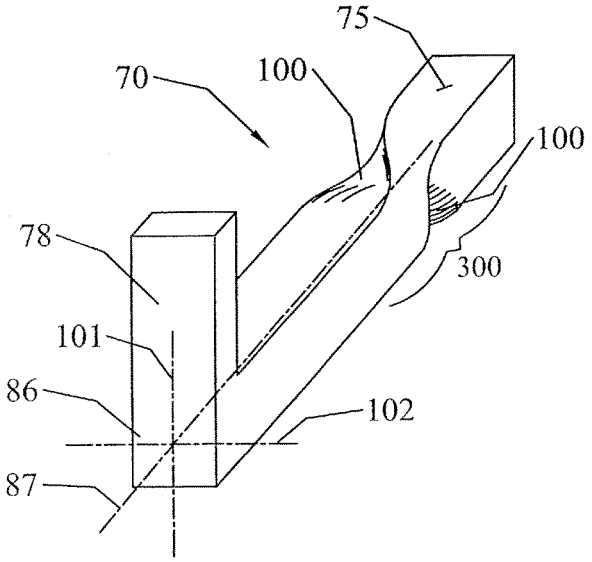

In one embodiment, a pin cylinder can have at least one twist somewhere along the longitudinal axis, such that the proximal end 80 has a face 81 with a long axis 101 and a short axis 102, such as shown, for example, in FIGS. 10A and 11A. The twist 100 can cause the distal end 85 to have a face 86 where the long axis 101 and the short axis are altered from their positions on the proximal face, as also shown in FIGS. 10A and 11A. When viewed from the proximal end 81 of the pin cylinder, such as in FIGS. 10B, 10C, 11C and 11D, the twist 100 changes the orientation of the axes, causing the ends of the long axis 101 at the distal end face 86 to be visible from the proximal end face 81, as shown in FIGS. 10B and 10C. This configuration could also be reversed so that the long and short axes on the proximal end face and distal end face are opposite in orientation. The mechanism by which a twisted pin cylinder rotates is the interaction with a pin hole 34, which translates the linear movement of a twisted pin cylinder into rotational movement as well. Ideally, the circumferential shape of a twisted pin cylinder and/or the pin hole is such that frictional interference or "stiction" between the pin hole and the pin cylinder is minimized. Thus, as long as a pin hole opening is configured appropriately, a twisted pin cylinder can have numerous configurations, as would be understood by a person of skill in the art.

Figure 11D:
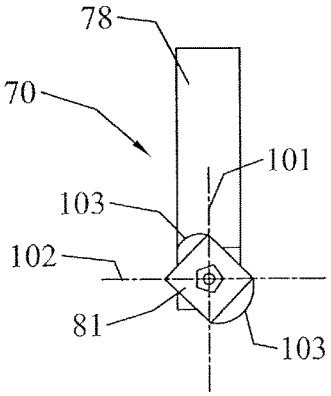

A pin cylinder 71 can also have a twist 100 or rotation of any desired turn radius. Ideally, the turn radius is sufficient to rotate the distal end of a pin cylinder so that other structures on the pin cylinder, such as, for example, a latch 78, can engage with one or more structures on the safe body. The embodiments shown, by way of example, in FIGS. 10A and 11A have a pin cylinder with twist having a turn radius of about 90° between the proximal end 80 and the distal end 85. A twisted pin cylinder can also have a twist or turn radius that is greater than or less than 90°. Such as illustrated in FIG. 11D The length of the twist on a pin cylinder can also be less than the distance between the two ends of a pin cylinder. Thus, a twist could span the entire length of a pin cylinder, as shown in FIG. 10A, such that the full rotation of the distal end is not achieved until the pin cylinder has passed entirely or almost entirely through the pin hole. Alternatively, a twist could be isolated to a smaller portion of a pin cylinder such that the full rotation is achieved when shorter, twisted portion passes through the pin hole, as shown in FIG. 11A. In one embodiment, the turn radius of a twist is 360°, such that the proximal end and distal end appear aligned, when viewed from an end. In another embodiment, the turn radius of the twist on a pin cylinder is between approximately 45° and approximately 270°.

It can be beneficial if the twist 100 in a pin cylinder is configured so that the dimensions of the twisted portion of a pin cylinder are consistent with the dimensions of the pin cylinder in non-twisted areas of the pin cylinder. Thus, the height and/or width of a pin cylinder would remain constant, such that the twist in the pin cylinder is not narrower or does not have less material than other portions of a pin cylinder. For example, when a pin cylinder that has a substantially square circumferential shape has a twist, the height and width of the pin cylinder remains substantially the same when measured at any point within the twist. Depending upon the shape of the pin cylinder circumference, maintaining the dimensions of the pin cylinder through the twist can, but does not necessarily, impart the pin cylinder with one or more raised areas 103 that imparts the pin cylinder with a larger diameter in the twisted areas, such as shown, for example, in FIGS. 10B, 10C, and 11C and 11D. One or more clearance cuts 36, as described above, can be beneficial in these instances, as it can allow the enlarged diameter to pass through the pin hole, but maintain minimal tolerance between the pin cylinder and the pin hole, as discussed above. It is within the skill of person trained in the art to determine an appropriate turn radius for a twist in a pin cylinder. Such variations are within the scope of this invention.

Further, a pin cylinder can have more than one twist along the length, between the distal end and proximal end. The twist can beneficially inhibit a pin cylinder 34 from being forced away from the door periphery 31, as described above. A pin cylinder with more than one twist can be further inhibited from forceful displacement from the door periphery. Still further a pin cylinder with more than one twist, each having a different turn radii, or different directions of twist, can be further inhibited from being forced out of place over the door periphery.

In embodiments that utilize a latch 78, it can be helpful for the turn radius of a twist 100 to be sufficient that when the pin cylinder is fully extended, and one or more rotations or partial rotations are completed, the latch is properly emplaced and secured to the safe body or other structure. The position of the latch can depend upon the turn radius of each of the one or more rotations of a pin cylinder. By way of non-limiting example, a latch can be oriented on or about the distal end so that it makes an approximately 360° revolution as the twisted pin cylinder is pushed through a pin hole. By way of another non-limiting example, a latch can he oriented on or about the distal end so that it rotates between approximately 10° and approximately 260° as the pin cylinder traverses the pin hole. A person with skill in the art will appreciate that the turn radius of a twist will depend upon a variety of factors. Such variations in the turn radii, which provide substantially the same function, in substantially the same way, and with substantially the same results, are within the scope of this invention.

Figure 9C:
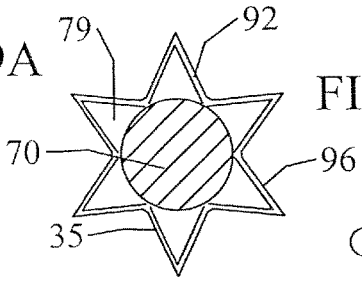
Figure 9E:
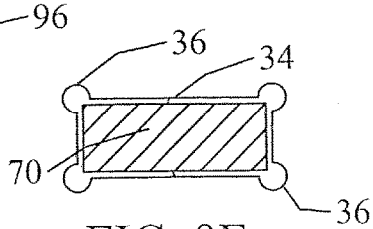

The shape of a latch can also determine the amount of rotation or the pitch of the cam track necessary to ensure that the latch is sufficiently rotated and, ideally, maximally displaced. By way of non-limiting examples, FIGS. 9A and 9B illustrate examples of keyholes 92 in which a latch matching the shapes thereof could be turned approximately 90° to provide maximum displacement of the latch from alignment with these keyholes, while FIG. 9C illustrates a keyhole embodiment where a latch could be rotated approximately 45° to achieve maximum displacement from alignment with the keyhole. Other latch embodiments are possible that can require rotation of the latch by any number of degrees that may be more or less than those mentioned here. The methodology for determining the length and pitch of the curved run of a cam track or the turn radius of a pin cylinder to achieve the desired latch rotation are understood by those with skill in the art. Variations in the curved run and latch rotation or turn radius that provide the same function, in substantially the same way with substantially the same result are within the scope of this invention.

The shape of a latch 78 can vary depending upon any of a variety of factors, some of which have been discussed above. In one embodiment, the circumferential shape of a latch is substantially the same as the circumferential shape of the keyhole through which it will pass. In an alternative embodiment, the circumferential shape of a latch is different from the circumferential shape of the key hole through which it will pass. In a further embodiment, a latch can have one or more surfaces that are curved, smooth, rounded, or otherwise shaped to inhibit gripping or grasping of the latch. Alternatively, a latch can be at least partially formed of or be at least partially coated or covered with a material having a low coefficient of friction to inhibit gripping or grasping of the latch. This can reduce or eliminate the ability to forcibly turn the latch during a breach attempt.

When a latch engages with a keyhole, it can be in close contact with the surface(s) around the key hole. While this is not required, as mentioned above, there can be advantages to this arrangement. In one embodiment, a key hole 92 has a front side 94 through which a latch enters and a back side 96 from which the latch emerges, as shown in FIG. 4B. The area around the key hole front side 94 can be referred to as the front side surface 95 and the area around the key hole backside 96 can be referred to as a backside surface 97. In a further embodiment, a latch has a surface or shoulder 79 that, as demonstrated in FIGS. 3A-3C, can contact the backside surface. As stated, the shoulder 79 does not have to contact the backside surface. Embodiments of the subject invention will operate quite adequately if the backside surface and shoulder to not make contact. For some embodiments, it can be preferable for the backside surface and shoulder not to make contact or at least not to make full contact between them. Thus, the pin cylinder could be configured to drive a latch through a keyhole a sufficient distance that the latch or any part of the shoulder thereon would not make contact with any surface around the keyhole. Alternatively, the pin cylinder could be configured to drive a latch through a keyhole a sufficient distance that the latch or the shoulder thereon has partial contact with a surface or other structure, described below, around the keyhole. Thus, while the following embodiments describe features of and advantages to having the latch or shoulder have at least partial contact with the backside surface 97, it is not required for all embodiments of the subject invention.

In one embodiment, a latch emerging from the back side 96 of a keyhole, when rotated, will make contact with the backside surface 96 with at least the shoulder 79. FIGS. 9A-9D illustrate examples of different latch shapes, where the shoulder 79 is seen through compatibly shaped key holes. Such contact between a shoulder and the backside surface can be sufficient to inhibit the latch from randomly turning or rotating or rattling against the backside surface. In a more specific embodiment, there can be a minimal space tolerance between the latch and the backside surface. This can provide a friction fit that inhibits the latch from rotating or turning unassisted. It can also inhibit or prevent articles or tools from being inserted therebetween to dislodge, rotate, or otherwise move the latch out of an unaligned position.

Figure 3E:
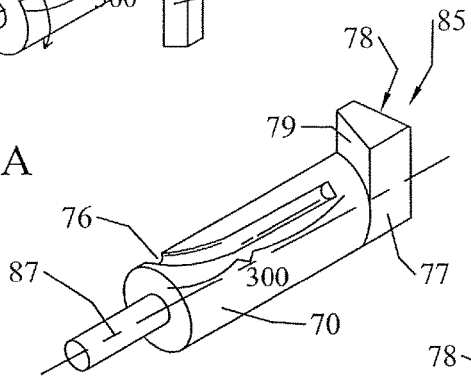
FIG. 3E illustrates an embodiment of a pin cylinder having a pressure wall.

FIG. 3E illustrates an embodiment of a pin cylinder 71 having a latch 78 at or near the distal end in the form of a pressure wall 77. A pressure wall can have an angled shoulder 79, whereby one side of the shoulder is closer to the distal end 85 than the other side, providing a surface that is angled relative to the longitudinal axis 87 of the pin cylinder. This embodiment could be utilized with the existing door frame on a safe body. FIGS. 4A and 4B illustrate a safe having a projecting lip 18 associated with the door frame 17 on a safe body. When the pin cylinder is turned the more distal end of the shoulder will move towards the projecting lip first. As the pin cylinder continues to turn, the angle of the pressure wall will bring the shoulder in closer proximity to the door frame and/or the projecting lip, until it makes a solid, stiction fit connection with the door frame and/or the projecting lip. This can cause the pressure wall to abut against the projecting lip and/or the door frame with minimal tolerance therebetween, creating a secure friction fit that can inhibit movement of the pin cylinder. In one embodiment the shoulder 79 of a pressure wall is rigid. In an alternative embodiment, at least a portion of the shoulder of a pressure wall is semi-rigid, flexible, or otherwise deformable. This embodiment can be useful for closures in which an air tight or water tight seal may be desired.

As mentioned above, safes 10 can be breached by drilling holes in their sides in order to access the pin cylinders and push them away from the door frame 17. They can also be susceptible to pry attacks, where all or part of the door of a safe is bent and causes one or more of the lock pins to be moved away from the door frame. The embodiments of the subject invention can inhibit or prevent this by ensuring that a latch is properly positioned, i.e., out of alignment with a keyhole, and against the backside surface. By configuring embodiments so that the latch abuts against the backside surface, it can reduce the likelihood of breaking or bending a latch during a breach attempt.

In a further embodiment, the backside surface can have structures that ensure adequate abutment of the latch. Such abutment structures 99 can promote "stiction" between the latch and the backside surface. Thus, while stiction is beneficially inhibited between a pin hole and a pin cylinder, stiction can be advantageous between a latch and the backside surface. In one embodiment, an abutment structure is a roughened or scored area on the backside surface against which the latch shoulder makes contact when it rotates. In another embodiment, an abutment structure is one or more ribs, nibs, or other rises on the backside surface against which the latch shoulder can be abutted. These and other similar types of abutment structures, can increase the frictional force between the latch and the backside, which can translate into increased stiction or friction fit. FIG. 4B illustrates some examples of abutment structures that can be employed with latch embodiments of the subject invention.

In another embodiment, the latch, or some portion thereof, and/or the abutment structure can have a predetermined amount of resiliency or flexibility. This can allow a latch having a particular shape to slide over an abutment structure 99 on the backside surface. For example, there can be one or more ridges or nibs or similar structures arranged on the back side surface. As the latch rotates, the resiliency of the latch, or portion thereof, and/or the abutment structure will allow one or both to deform sufficiently to slide, move, or otherwise pass over each other. In a further embodiment, the abutment structure can have a shape that makes it conducive for the latch to pass over, e.g., smooth or curved surfaces, ramp-like edges, etc. Alternatively, these types of abutment structures can be at least partially formed of a material that exhibits a low coefficient of friction. In a still further alternative, abutment structures can be a resilient or deformable material that permits the latch to temporarily deform the abutment structure as it passes over or slides over the abutment structure. In yet another alternative embodiment, one or more abutment structures can be spring-loaded or be in contact with another deformable object that allows the abutment structure to move or accommodate passage of a latch. The locking mechanism of a safe can impart sufficient force, along with the cam guide and cam track, to force a latch to pass over an abutment structure. After a latch slides over an abutment structure, it can make contact with the backside surface, an abutment structure, or both. This can provide the latch with a firm seating and minimize rattling, shifting, or random movement of the latch. It can also further inhibit the latch from being realigned with a key hole, unless the locking mechanism is utilized to impart the necessary linear motion to the pin cylinder, which forcibly rotates the latch so that it slides back over an abutment structure or otherwise disengages from an abutment structure. The topmost keyhole shown in FIG. 4B shows an abutment structure raised on the backside surface 97 over which a latch can slide as it turns.

Abutment structures are often utilized with socket wrenches as a technique for securing sockets to the pin on a wrench head. Common ink pens with removable caps often use abutment structures to hold the cap on the pen. The socket or pen cap can be removed by forcibly pulling the device over the abutment structure. Dispensing containers often use abutment structures to maintain an opening in the container at a particular position. Thus, there is a variety of abutment structures that could be beneficial for use with the embodiments of the subject invention. Any such variations that provide the same functionality and the same result as described here are within the scope of this invention.

Embodiments of a lock pin 70 of the subject invention can be configured to engage with one or more structures already present in current residential security container designs. Alternatively, a residential security container can be configured, modified, or designed to include a structure with which a lock pin can engage. Current residential security container designs usually include a reinforced door frame 17 against which their extended bolt cylinders abut to lock the residential security container when the door is closed. FIG. 4A illustrates vertical cross-section, taken along line A-A' shown in FIG. 2, in which an example of a reinforced door frame 17 can be seen.

The lock pin 70 embodiments of the subject invention are amenable for use with the already existing reinforced door frames on most safes. The example shown in FIG. 2 demonstrates how a pin cylinder of the subject invention when extended from the door panel frame 32 can have a latch configuration, such as that shown in 3A, which will adequately engage with the door frame. It can be seen that when the latch 78 is turned after the door 30 is closed, the latch shoulder 79 will be situated behind the door frame 17. FIG. 4B shows a partial reversed section of the door frame in FIG. 4A to demonstrate an example of the backside surface 97 of a strike plate, which will be discussed below. Also shown in FIG. 4B is a partial behind area 19 of the door frame, which illustrates that a latch of the subject invention can engage with a door frame 17.

Figure 3F:
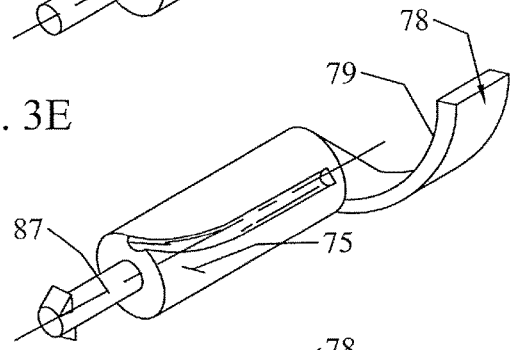
FIG. 3F illustrates an embodiment of a pin cylinder having a C-shaped arm for conjoining with a structure on a safe. This embodiment can cause increased pressure between the door and the door frame as the curvature of the arm pulls against the safe body.
Figure 3C:
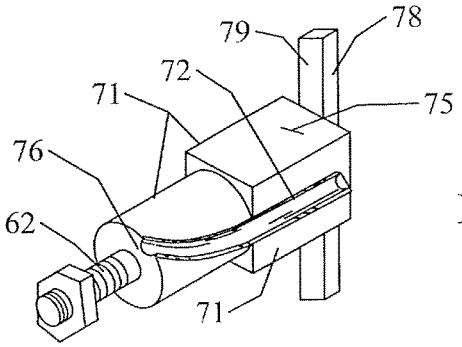
FIG. 3C illustrates an alternative embodiment of a pin cylinder, according to the subject invention.
Figure 3D:
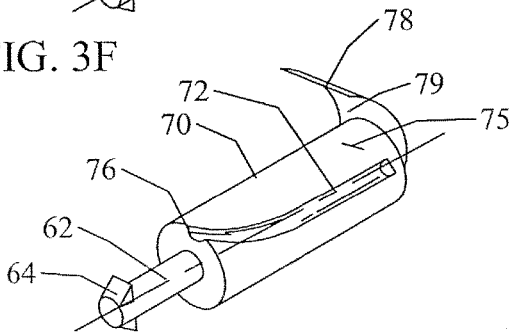
FIG. 3D illustrates another alternative embodiment of a pin cylinder, according to the subject invention.

In a specific embodiment, the latch is a recurved projection extending from at or about the distal end 85 of a pin cylinder, one example of which is shown in FIG. 3D. The door frame of some safes is reinforced by imparting a curvature or bend in the door frame material that makes it more difficult to bend out of place. This reinforcement technique can impart to the door frame a lipped projection or even a U-shape that opens along the behind area 19. FIG. 4C is a cross-section taken along line B-B' in FIG. 4A that illustrates one example of a reinforced door frame 17 in a safe 10 with which a recurved latch embodiment, like that shown in FIG. 3D, could be used to lock a safe. In this embodiment, the reinforced door frame assumes the operation of a key hole 92.

FIG. 3F shows an alternative embodiment where the latch 78 is a generally C-shaped arm having a shoulder 79 aligned with the longitudinal axis 87 of the pin cylinder. With this embodiment, the pin cylinder can rotate bringing a leg of the L-shaped flange into contact with a structure on the safe body or a strike plate. The structure on the safe body or the strike plate can be designed to receive the curved arm There are other techniques by which door frames of a safe are reinforced. Such techniques can provide alternative configurations to a doorframe. Thus, a latch according to the subject invention could assume a different shape or configuration in order to engage with a door frame. It is within the skill of a trained artisan to determine any number of door frame and/or latch configurations that would operate as described herein. Such variations which provide the same function, in substantially the same way, with substantially the same result, are within the scope of this invention.

It is also possible for a door frame 17 to be modified for use with a lock pin 70 of the subject invention. In one embodiment, the door frame is modified, configured, manufactured, or otherwise provided with one or more key holes 92, as described above. In FIG. 4C it can be seen that the reinforced door frame 17 of a safe can have a projecting lip 18 in which one or more key holes can be provided. This can allow the door frame to assume the characteristics of a strike plate 90. FIG. 4A illustrates a non-limiting example of a lip 18 having key holes therein.

However, if the projecting lip is not present or insufficient for one or more key holes, a separate strike plate 90 can be affixed to the door frame or some other component of the safe, for example, the safe body 15, and can provide one or more key holes for operation with one or more lock pins of the subject invention. FIGS. 4A and 4B illustrate non-limiting examples of a strike plate attached to a reinforced door frame. In these examples, the strike plate is fixedly attached to the projecting lip 18, shown in the example in FIG. 4C.

In general, a strike plate 90 is the apparatus against which a latch is operatively engaged to prevent a pin cylinder from retracting or being retracted to the door panel frame, or prevents a pin cylinder from being pried or pulled away from the safe body and thereby allowing the safe door to be opened. Thus, the strike plate should be able to withstand significant force applied thereto. A strike plate can assume any of a variety of configurations, including, but not limited to, having one or more sections, having reinforcement structures thereon, comprising a rigid material, having one or more key holes, being of similar construction or material as the rest of the safe, and other features understood by a person skilled in the art. It is also well-known that safes can have lock pins extending from any or all sides of a door frame, including the corners in certain models. Thus, a strike plate could be provided anywhere around a door frame 17 and not just in the area shown in FIG. 4A. It is within the skill of a person trained in the art to deteimine the proper construction for a strike plate, as part of the safe or a separate component added thereto, which can be employed with the various lock pin embodiments described herein. Any such variations, which provide the same functionality with substantially the same result, are within the scope of this invention.

As discussed above, one common technique implemented when attempting to breach a locked safe to insert a pry bar between the periphery of the door 31 and the safe body 15 and prying the door until one or more of the lock pins 70 are bent or distorted out of shape sufficiently to allow at least part of the door to be bent away from the door frame 17. The embodiments described above can be effective in preventing lock pins from being bent or pried away from the door frame. The use of a latch can further inhibit the ability to bend a pin cylinder.

Another technique that can be employed with a lock pin can be specifically engaged only when a pry attack is instigated against a safe. This technique employs a shouldered indent 200 formed within a pin cylinder that can abut against the projecting lip 18, a strike plate 90, or another structure within the safe, if force is applied to the door to try to bend it away from the safe body 15. When a lock pin is utilized normally, a shouldered indent on the lock pin does not inhibit or in any way affect the operation of the other embodiments described herein. The advantage of a shouldered indent is that it can be incorporated with other embodiments described herein and engaged as a last defense during an attempt to breach the safe if the other embodiments herein are overcome. It can also be employed as an alternative to one or more of the other embodiments described herein.

Figure 12C:
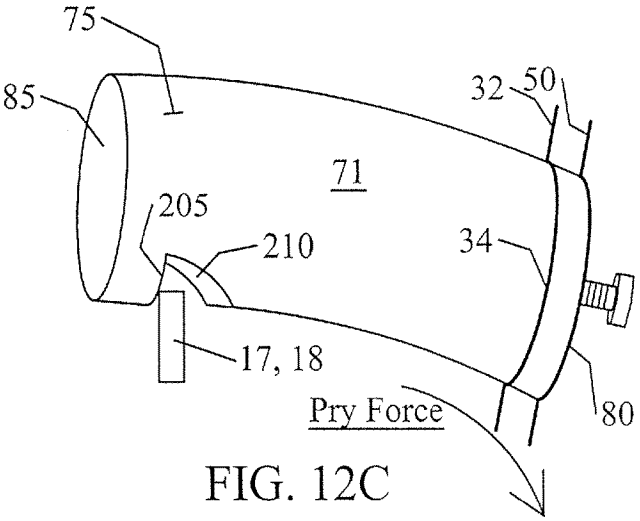
FIGS. 12A, 12B, 12C, and 12D illustrate embodiments of a shouldered indent.
Figure 12D:
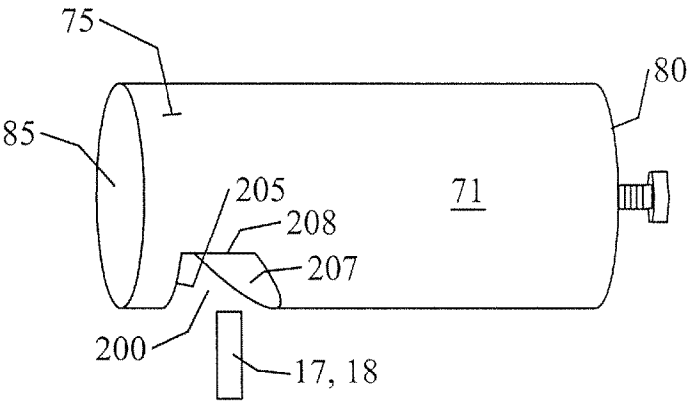
Figure 12A:
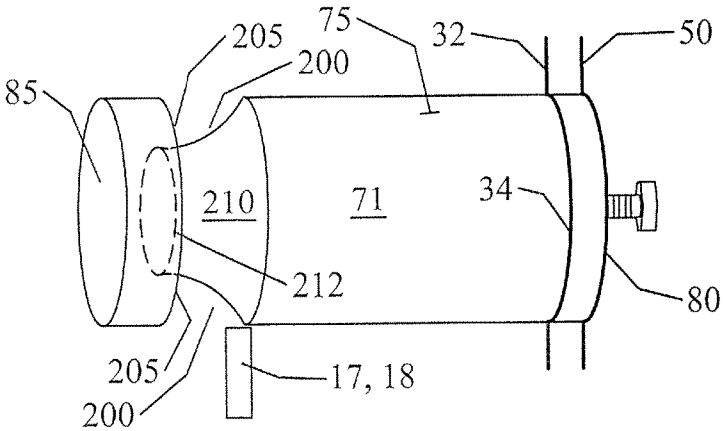
Figure 12B:
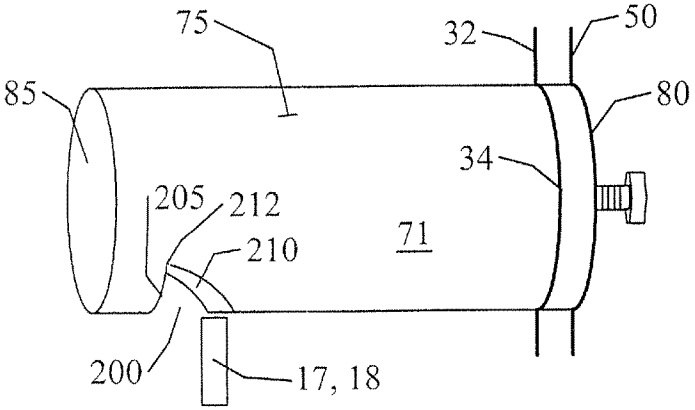

FIGS. 12A, 12B, and 12C illustrate embodiments of a pin cylinder having a shouldered indent 200 in a lock pin 70. In FIGS. 12A-12C, the shouldered indent is shown nearer to the distal end. However, it will be understood that a shouldered indent can be located anywhere on a pin cylinder, or at least in a position on a pin cylinder that would allow the shouldered indent to be engaged if the pin cylinder were bent by prying the safe door, as described above. In one embodiment, a shouldered indent 200 has an inclined surface 210 formed or cut into the pin cylinder 71 having a terminal end 212 that is below the outer surface 75 of the pin cylinder of the lock pin and meets an annular shoulder 205. The annular shoulder 205 and the inclined surface 210 can circumscribe a pin cylinder 71 of a lock pin 70, an example of which is shown in FIG. 12A, such that the inclined surface curves around the pin cylinder. Alternatively, the annular shoulder 205 and the inclined surface 210 can circumscribe a portion of a pin cylinder, so that the inclined surface is curved partially around the pin cylinder. In another embodiment, the inclined surface can be a flat or arcuate surface cut into the pin cylinder, perpendicular to or at intersection with the longitudinal axis 87, such that the inclined surface does not curve around the pin cylinder and terminates towards distal end 85 where it abuts an annular shoulder, which is illustrated, by way of example, in FIG. 12B.

In a further embodiment, the annular shoulder 205 is a surface between the terminal end 212 of the inclined surface 210 and the outer surface 75 of a lock pin. This surface can be perpendicular to the outer surface, such that it is substantially vertical relative to the longitudinal axis 87 of a lock pin. This surface can, alternatively, be angled or not vertical relative to the longitudinal axis. In a particular embodiment, the annular shoulder is angled towards the inclined surface as it nears the outer surface. One example of this is shown in FIGS. 12B and 12C.

There can also be an alternative embodiment wherein the shouldered indent has another, opposite annular shoulder, where the two annular shoulders are joined by the inclined surface. With this embodiment, the inclined surface can have an angle between 0° and 90°, such that the inclined surface can be generally parallel to the longitudinal axis 87 or be at any angle less than 90°, such that the inclined surface is not parallel to the longitudinal axis. FIG. 12D illustrates an example of this type of shouldered indent where the inclined surface is 0°, relative to the longitudinal axis or, in other words, is parallel to the longitudinal axis. The annular shoulders can also be parallel to each other. Alternatively, each annular shoulder can have the same or different angles relative to the longitudinal extent, such that they are not parallel with each other. FIG. 12D also illustrates an example of this type of shouldered indent where the two annular shoulders have different angles and, thus, are not parallel.

As describe above, when the door 30 of a safe is pried away from the safe body 15, it is typically moved in a direction that causes the lock pins 70 to be forced against some interior surface 5 of the door frame 17, or another structure attached to or near to the door frame, such as, for example, a strike plate 90. When enough force is applied, the lock pins will bend and slide over the door frame or structure, at least at the area of the door being pried. A shouldered indent 200 embodiment of the subject invention can deter bending of a lock pin by "catching", overlapping, or otherwise engaging with the door frame, or other structure or part thereof on the interior of the safe, inhibiting the lock pin from sliding, or continuing to slide, over the door frame. Because of the direction at which a prying force is applied to a safe door, the engagement of a shouldered indent with the safe body can further inhibit the one or more lock pins from being bent. Once a shouldered indent has engaged with some part of the safe body or other structure on the safe interior 5, the lock pin is inhibited from further bending or, at least, significantly more force can be required to not only bend the lock pins, but also bend or distort the additional structure to which the shouldered indent on the lock pin has become engaged.

FIG. 12C illustrates an example of this where an embodiment of a shouldered indent 200 is engaged with the projecting lip 18 on a safe body as the lock pin is forced against and bent over the projecting lip 18 or other structure on the door frame 17, during a pry attack. Also shown is how the door panel frame 32, door carriage 50, and the proximal end 80 of the lock pin can be bent out of place during a pry attack. This initial bending of the lock pin can cause enough distortion in the shape of the lock pin that the shouldered indent can than engage with the safe body. FIG. 12C further illustrates how an annular shoulder can engage with the projecting lip on the interior of a safe. If the pry attack is continued, the contact between the annular shoulder and the safe structure to which it has abutted can provide further resistance against direct force against the door.

The shouldered indent 200 embodiments of the subject invention can be configured so that, when the safe is locked, a shouldered indent 200 on a lock pin 70 is adequately aligned with or facing one or more of the door frame 17, projecting lip 18 on the door frame, the edge of a key hole 92 in strike plate 90, or another part of the safe against which a lock pin can be forced during a pry attack. By ensuring that the shouldered indent is properly aligned when the safe is locked, any attack against the door, particularly a pry attack along the door edge, will cause the shouldered indent to be engaged if a pre-determined amount of force is applied to the door, lock pin, door frame, or other structure. As stated above, when a lock pin is utilized noimally, a shouldered indent has no effect on the operation of the lock pin. When a pre-determined amount of force is applied to the door, the lock pin or some other structure in the safe can become distorted, bent, misaligned, or otherwise out of place. This can then cause the shouldered indent to also become misaligned or out of place, causing it to operate as described. The lock pins used in a typical safe are rigidly fixed to a carriage 50 by posts or rods that go through holes in the carriage. The posts or rods are then secured to the carriage with a bolt, rivet, welding, or other devices or techniques that immovably secure the bolt cylinder to the carriage.

For a lock pin of the subject invention to operate as described herein, the lock pin should be able to rotate at least partially around the longitudinal axis 87 of the pin cylinder, as demonstrated in FIG. 3A. To permit such rotation, the lock pin embodiments of the subject invention can be moveably or rotatably attached to a carriage by a rotating connector apparatus 60. A rotating connector apparatus can be any of a variety of mechanisms that allow the pin cylinder to rotate. In one embodiment, a rotating connector apparatus utilizes a rigid rod 62 fixedly attached to or as part of the proximal end 80 of a pin cylinder. The rigid rod can be positioned through hole 58 in the carriage, an example of which is shown in FIG. 6. As mentioned above, the embodiments of the subject invention are amenable for retrofitting already existing safes, with minimal modification. In a particular embodiment, the embodiments of a rigid rod 62 can be disposed within the same holes used for previously existing bolt cylinders in a safe. This can beneficially also align pin cylinder embodiments of the subject invention with the already existing pin holes 34 in a door panel frame.

A rigid rod can be secured within hole 58 by any device or technique that allows the rigid rod to turn or rotate within the hole, thereby allowing the pin cylinder attached thereto to turn or rotate on the longitudinal axis. There are any of a variety of connector devices 64 by which a rigid rod can be rotatably secured to a carriage. This can include, but is not limited to, bolts, cotter-pins, rivets, rod caps, or other devices, shown, for example, in FIGS. 3A and 3C, that prevent the rigid rod from being removed from the hole and allow it to rotate. The rigid rod itself can also have structures, such as projections, welding material, tabs, pawls, flanges, or other features thereon, shown, for example, in FIG. 3D, or it can be bent or curved in a fashion that provides the desired rotation within a hole. A skilled artisan would be able to determine one or more appropriate devices or techniques for securing a rotatable rigid rod in a hole. Such variations are within the scope of this invention.

The embodiments of the subject invention represent a unique and beneficial improvement to the design and operation of residential security containers. The lock pin designs disclosed herein address undesirable design issues with currently known residential security containers, wherein the door of a residential security container can be breached if access to the bolt cylinders can be achieved. The pin cylinder embodiments described herein can prevent or inhibit a pin cylinder from being pushed away from the door frame. Other embodiments disclosed herein can further prevent all pin cylinders from being disengaged from the door frame, should access to a single pin cylinder be achieved. The embodiments described herein can provide greater security and value to a residential security container with minimal modification to current designs.

The examples and embodiments described herein are for illustrative purposes only and various modifications or changes in light thereof will be suggested to persons skilled in the art and are to be included within the spirit and purview of this application.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. Further, when a particular feature, structure, or characteristic is described in connection with any embodiment, it is within the purview of one skilled in the art to affect such feature, structure, or characteristic in connection with other ones of the embodiments.

The invention has been described herein in considerable detail, in order to comply with the Patent Statutes and to provide those skilled in the art with information needed to apply the novel principles, and to construct and use such specialized components as are required. However, the invention can be carried out by specifically different equipment and devices, and that various modifications, both as to equipment details and operating procedures can be effected without departing from the scope of the invention itself. Further, although the present invention has been described with reference to specific details of certain embodiments thereof and by examples disclosed herein, it is not intended that such details should be regarded as limitations upon the scope of the invention except as and to the extent that they are included in the accompanying claims.

I claim:

1. A lock pin mechanism for securing a closure to a structure, the lock pin mechanism comprising:

a carriage on the closure and within the structure;

at least one pin cylinder affixed to the carriage, each pin cylinder comprising a proximal end, a distal end, and a curvature of rotation therebetween, the pin cylinder being linearly moveable along a longitudinal axis of the pin cylinder;

a rotation facilitator on the closure that engages with the curvature of rotation, and a rotating connector apparatus at the proximal end that rotatably attaches the proximal end of the pin cylinder to the carriage;

such that each pin cylinder is independently rotatably attached to the carriage and is moveable, by the carriage, along the longitudinal axis of each respective pin cylinder, causing each rotation facilitator engaged with the curvature of rotation of each respective pin cylinder to rotate each pin cylinder on the carriage and around the longitudinal axis of the respective pin cylinder, so as to engage each pin cylinder with the structure.

2. The lock pin mechanism, according to claim 1, wherein the pin cylinder has a non-circular circumference and the curvature of rotation comprises a twist, such that the distal end is rotated relative to the proximal end.

3. The lock pin mechanism, according to claim 2, wherein the rotation facilitator is a pin hole through which the pin cylinder is disposed, wherein the pin hole is configured to engage with the twist as the pin cylinder moves linearly, so as to cause the pin cylinder to rotate.

4. The lock pin mechanism according to claim 2, wherein the twist has a turn radius of between approximately 45° and approximately 270°.

5. The lock pin mechanism according to claim 4, wherein the twist has a turn radius of between 60° and 120°.

6. The lock pin mechanism according to claim 1, further comprising a latch fixedly connected to the distal end of the at least one pin cylinder, where the orientation of the latch is controlled simultaneously with the rotation of the pin cylinder.

7. The lock pin mechanism according to claim 6, wherein the latch engages with the structure when the pin cylinder rotates.

8. The lock pin mechanism according to claim 7, wherein the closure is a safe door and the structure is a door panel frame on the safe.

9. The lock pin mechanism according to claim 6, further comprising at least one key hole in the structure through which the latch passes when the pin cylinder moves longitudinally, such that, as the pin cylinder continues to move longitudinally, the latch simultaneously engages with the structure and becomes misaligned with the key hole to inhibit the latch from backing through the key hole and disengaging with the structure.

10. The lock pin mechanism according to claim 9, wherein the key hole and the latch have similar circumferential shapes, such that the latch fits through the key hole only when the latch and key hole are aligned.

11. The lock pin mechanism according to claim 9, further comprising a strike plate adapted to be attached inside the structure, the strike plate comprising the at least one key hole such that the latch engages with the strike plate.

12. The lock pin mechanism, according to claim 1, further comprising a shouldered indent having at least one annular shoulder at or about the distal end of the pin cylinder.

13. The lock pin mechanism according to claim 12, further comprising an inclined surface within the pin cylinder that terminates at the annular shoulder.

14. The lock pin mechanism according to claim 12, further comprising two annular shoulders on each end of the inclined surface.

15. The lock pin mechanism according to claim 1, wherein the curvature of rotation comprises at least one cam track.

16. The lock pin mechanism according to claim 15, wherein the rotation facilitator comprises at least one cam guide.

17. The lock pin mechanism according to claim 16, wherein the cam track comprises a straight run portion for moving the pin cylinder without rotation and a curved run portion for rotating the pin cylinder.

18. The lock pin mechanism, according to claim 17, wherein the cam track comprises an entirely curved run.

19. A method for securing a closure to a structure, the method comprising:

utilizing at least one lock pin mechanism, according to claim 1, advancing the carriage so that the independently rotatable pin cylinder of the at leas one lock in mechanism moves along the longitudinal axis of the pin cylinder, such that the rotation facilitator engaged with the curvature of rotation of the pin cylinder of the at least one lock pin mechanism causes the pin cylinder to rotate on the carriage, so as to engage the pin cylinder with the structure.

20. A safe comprising:

a safe body having a hollow interior and a safe door;

a locking mechanism on the safe door that is operated to control the movement of at least one carriage in the hollow interior; and at least one lock pin mechanism, according to claim 1, where the lock pin mechanism rotatably attached to the at least one carriage and the engages with the safe body.

* * * * *